US007255639B2

(12) United States Patent
Abe et al.

(10) Patent No.: US 7,255,639 B2
(45) Date of Patent: Aug. 14, 2007

(54) COIN DELIVERY DEVICE AND SEPARATOR DEVICE FOR A COIN PROCESSING APPARATUS

(75) Inventors: Hiroshi Abe, Iwatsuki (JP); Minoru Enomoto, Iwatsuki (JP); Masayoshi Umeda, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/182,113

(22) Filed: Jul. 15, 2005

(65) Prior Publication Data

US 2006/0019591 A1 Jan. 26, 2006

(30) Foreign Application Priority Data

Jul. 15, 2004 (JP) ..... 2004-209192
Aug. 5, 2004 (JP) ..... 2004-229086

(51) Int. Cl.
*G07D 1/00* (2006.01)

(52) U.S. Cl. ..... 453/18; 453/56

(58) Field of Classification Search ..... 453/18, 453/3, 7, 11, 33, 34, 35, 49, 51, 56, 57; 194/342; 209/922; 198/348, 370.01
See application file for complete search history.

(56) References Cited

U.S. PATENT DOCUMENTS 1,813,296 A * 7/1931 Kidwell ..... 453/12
2,684,155 A * 7/1954 Hartrampf ..... 209/623
3,233,778 A * 2/1966 Cobb et al. ..... 221/232
4,279,336 A * 7/1981 Henderson et al. ..... 198/443
4,558,711 A * 12/1985 Yoshiaki et al. ..... 453/3

FOREIGN PATENT DOCUMENTS

EP 0.209.675 A1 * 1/1987
JP 11-328469 11/1999

* cited by examiner

*Primary Examiner*—Patrick Mackey
*Assistant Examiner*—Mark J. Beauchaine

(57) ABSTRACT

A compact coin delivery device includes a rotary disk with indented concave portions for receiving a coin from a hopper or a coin storage bowl. A movable member in the concave portion can have controlled movement for ejecting the coin at a desired location. An endless conveyer member with pins can receive the coin and transport it in an L-shaped path. The coins can be released to individual chutes for separating coins of different dimensions and denominations, both on a path away from the coin delivery device and on a return path to the coin delivery device. Solenoid activated members can assist in displacing certain coins from the conveyor path, including into a separate retention or storage box.

11 Claims, 14 Drawing Sheets

COIN DELIVERY DEVICE AND SEPARATOR DEVICE FOR A COIN PROCESSING APPARATUS

BACKGROUND OF THE INVENTION

1. Field of the Invention

The present invention relates to a compact coin delivery device which delivers coins of a plurality of denominations and having different diameters, one by one for delivery to a coin processing apparatus which can sort coins having different diameters one by one for transfer to a conveyer of the coins.

2. Description of Related Art

It is to be noted that the term "coin" used in the present specification includes a monetary coin, a token, a medal and the like, and further includes circular and polygonal shapes.

Japanese Laid Open Application No. 8-171666 discloses hooking coins by pins fixed to an upper surface of a rotary disk to sort the coins one by one, and transferring the coins to a conveyer for a subsequent process.

Japanese Utility Model Application No. 57-50776 includes receiving coins, one by one, in fan-shaped concave portions opening on an upper surface side and peripheral surface side of a rotary disk, and transferring the coins to a conveyer for a subsequent process.

In the prior art, coins of predetermined denominations are separated at a reject coin branching section and at an overflow branching section in the process of being conveyed by a conveyer belt, and then the coins are dropped through select-by-denomination holes for separation by denomination as shown in Japanese Utility Model Registration No. 2600066

The sorting of the hooked coins is regulated only by the space between the pins.

Thus, when a difference between the diameters of a maximum diameter coin and a minimum diameter coin is great, the maximum diameter is 28.5 mm of a two-pound coin and the minimum diameter is 18 mm of a five-pence coin, for example, in the case of English currency a problem can occur.

Since the pin space is set considering enough room for different coin accommodation, two minimum diameter coins can slip between a pair of pins, which can cause a problem in that they are not sorted one by one. If the coin is received in a fan-shaped concave portion, two minimum diameter coins do not enter the concave portion. However, gravity is utilized for the transfer to the conveyer for the subsequent process, so that the position of a coin dispensing slot cannot be freely set, leading to a problem of limitation in layout.

In the prior art described above, all the coins are separated into reject coins, overflow coins or denominated coins before being passed through the select-by-denomination holes by the conveyer belt. Specifically, the select-by-denomination holes are arranged in the order of the increasing diameters of the coins along a conveyer path of the coins. The width (orthogonal to the direction in which the coin proceeds) of the select-by-denomination hole is formed slightly larger than the diameter of a target coin. Therefore, the coins are dropped by their own weight through the corresponding select-by-denomination holes and are thus separated.

In recent years, to increase the speed of separating the coins, the speed of conveying the coins has been significantly increased, which can cause a problem in that they are not separated by a predetermined denomination That is, inertia force by the high-speed movement of the coins has caused a problem because the coin cannot drop in the selection hole having a conventional length (length in the direction in which the coin proceeds), and drops in the next selection hole in rare cases.

Thus, the prior art in a highly competitive field is still seeking to resolve the above problems in a compact and economical design.

SUMMARY OF THE INVENTION

An object of the present invention is to provide a coin delivery device which, even when coins of a plurality of denominations having a large difference in diameter are mixed, can sort the coins one by one for delivery.

A second object of the present invention is to provide a coin delivery device in which a dispensing position of a coin can be freely set.

A third object of the present invention is to provide a compact coin delivery device.

A coin delivery device for a coin processing apparatus holds coins in sorting concave portions arranged in an upper surface of a rotary disk to sort the coins one by one, and then transfers the coins to a coin conveyer, a moving member is provided which can variably form the concave portion and is movable in a diametrical direction of the rotary disk, and wherein the moving member is moved in the diametrical direction of the rotary disk to assist the discharge when the coin is transferred to the coin conveyer.

In this configuration, the coins are received in the concave portions and thus sorted one by one. That is, only one coin can be positioned in the concave portion, so that two minimum diameter size coins are not held together in the sorting concave portion.

When the concave portion moves to a position for transfer to the coin conveyer, the moving member forming a concave portion moves in the diametrical direction of the rotary disk. This movement causes the coin held in the concave portion to actively move in the diametrical direction of the rotary disk, so that the coin can be transferred to the coin conveyer at its moving portion.

In other words, there is an advantage that the dispensing position is not limited since the dispensing position of the coin can be controlled by the moving position of the moving member.

The coin delivery device of the coin processing apparatus can be characterized in that the concave portion of the rotary disk is fan-shaped so as to be free on an upper surface side of the rotary disk and to be open on a peripheral surface side of the rotary disk, and has a coin pushing portion at one part thereof, and in that the moving member is positioned at a side of the pushing portion when the coin is received, and moved to the peripheral surface opening side when the coin is transferred.

In this configuration, since the concave portion is open on the upper side and peripheral surface side of the rotary disk, the coins in a retention bowl at which the disk is positioned are stirred by the rotation of the rotary disk, such that one coin is received in the concave portion. In other words, the fan-shaped concave portion is sectioned by its edge and a retention ring so as not to hold two minimum diameter coins.

Furthermore, the coin is moved by the concave coin pushing portion. The moving member then moves toward the peripheral surface opening side at a predetermined position, and pushes out the coin from the lateral side to the peripheral surface opening side. The pushed-out coin is received by the coin conveyer, and conveyed to a subsequent process.

As the pushing portion to push the coin is formed in the rotary disk, it can be made of a material having a desired durability.

Furthermore, the moving member pushes the coin from the lateral side and thus no great force is required, thereby allowing a size reduction. Therefore, there is an advantage in that the coin delivery device can be reduced in size.

The coin delivery device of the coin processing apparatus wherein the moving member is arc-shaped and attached to the rotary disk so as to be able to pivot on one end, and a moved member attached to the moving member is inserted in a groove cam located under the rotary disk. In this configuration, because the moving member is arc-shaped, its concave portion accepts a circular peripheral edge of the coin. The moving member and the moved member move together with the rotary disk, and the moved member is guided by the fixed groove cam, thus providing an advantage that no extra driver is needed.

Furthermore, by properly setting the shape of the groove cam, the moving member can be moved at a predetermined position in the diametrical direction of the rotary disk, so that the coin retained in the concave portion can be delivered at the predetermined position. Therefore, the coin delivery device can be reduced in size and is inexpensive.

A coin delivery device can include a rotary disk whose axis line is inclined at a predetermined angle; a sorting concave portion whose upper side and peripheral surface side are open in an upward surface of the rotary disk and in which at least one minimum diameter coin is positioned and two minimum diameter coins are unacceptable; a moving member which is attached to the concave portion of the rotary disk in a manner to be able to pivot and which is movable between a receiving position to form the sorting concave portion and a moving position where the moving member is moved to the opening side; a moved member attached to the moving member; and a groove cam disposed under the rotary disk and receiving the moved member.

In this configuration, the moving member is located at the receiving position except when the coin is dispensed, so that the coins are received in the sorting concave portions and held one by one. That is, at least one minimum diameter coin can be only positioned in the concave portion, and therefore, two minimum diameter coins are not positioned together.

When the coin is dispensed, the moving member moves to the moving position, and the coin held in the concave portion is thus moved by the moving member in the diametrical direction of the rotary disk This movement causes the coin held in the concave portion to actively move toward the peripheral surface of the rotary disk, so that the coin can be delivered from the rotary disk at the predetermined portion. In other words, there is an advantage that the dispensing position is not limited since the dispensing position of the coin can be controlled by the position of the moving member.

The coin delivery device can be characterized in that the moving member can be attached to a pivot shaft located closer to a peripheral edge side of the rotary disk than the moved member. In this configuration, since a pivot shaft of the moving member is attached to the pivot shaft located closer to the peripheral edge side of the rotary disk than the moved member, the moved member is positioned in the groove cam after the rotary disk has been rotated.

In other words, the pivot shaft moves prior to the moved member, and the moved member is moved by the groove cam at such a position as to trail the pivot shaft. Therefore, a great force is not applied to the moved member, and there is thus an advantage that the coin delivery device can be reduced in size and can be made inexpensively.

A coin delivery device which holds coins in sorting concave portions arranged in an upper surface of a rotary disk where at least one minimum diameter coin can only be positioned, so as to sort the coins one by one, and then transfers the coins to a coin conveyer, the coin delivery device including: the rotary disk whose axis line is inclined at a predetermined angle; the sorting concave portion whose upper side and peripheral surface side are open in an upward surface of the rotary disk and in which at least one minimum diameter coin is positioned and two minimum diameter coins are unacceptable; a moving member which is attached in a manner to be able to pivot to form the concave portion of the rotary disk and which is movable between a receiving position located at a side portion of the sorting concave portion and a moving position where the moving member is moved to the opening side; a moved member attached to the moving member; and a groove cam disposed under the rotary disk and receiving the moved member, wherein the moving member is moved in a peripheral surface direction when the coin is transferred to the coin conveyer.

A fourth object of the present invention is to provide a small coin processing apparatus capable of separating coins by denomination even when the speed of conveying the coins is increased.

To attain this object, a coin processing apparatus sorts coins of a plurality of denominations one by one by the delivery device, and then transfers the coins to a conveyer, and separates the coins by denomination in a coin separating section disposed on a conveyer path of the conveyer, characterized in that a guide device is provided to guide the coin which has reached a lowermost portion of the conveyer path to the delivery device.

In this configuration, the coins are transferred to the conveyer after being sorted one by one by the delivery device.

The coins conveyed by the conveyer are generally separated in the coin separating section disposed on the conveyer path of the conveyer, and accumulated by denomination.

However, for example, when a maximum diameter coin is not separated in a predetermined separating portion, the maximum diameter coin is not separated in other separating portions, and reaches the lowermost portion of the conveyer path, and is then guided by the guide device to be returned to the delivery device.

Thus, the unseparated coins are transferred again to the conveyer, and separated on the conveyer path. When the coin is not separated, the coin is circulated between the delivery device and the conveyer until it is separated. Therefore, the coins can be separated in the predetermined denomination selecting section without extending the separating section, so that the apparatus is not increased in size and the separating rate is increased.

The coin processing apparatus can have a conveyer path with a first separating section extending linearly substantially in a horizontal direction from the delivery device; and a second separating section extending successively from the first separating section in an opposite direction above the first separating section, and wherein the conveyer path has a toppled U shape as a whole, and wherein a lowermost portion of the second separating section is disposed above the delivery device.

In this configuration, the first separating section and the second separating section are arranged one above the other, so that the separating sections are arranged in a two-story form. Thus, the depth is about half of a conventional depth, providing an advantage in that a size reduction is allowed.

The coin processing apparatus wherein the delivery device of the coin includes a concave portion which is formed in an inclined rotary disk and whose upper surface and peripheral surface are open; and a moving member which is usually held at a receiving position to form the concave portion and which, at a predetermined position of the rotary disk, moves in a diametrical direction of the rotary disk, and wherein the conveyer includes pins provided in an endless proceed member; and a guide which guides the coin moved by the endless proceed member.

In this configuration, the coins entered the concave portions of the rotary disk and sorted one by one are moved at a predetermined position in a circumferential direction of the rotary disk by the moving member, and pushed out to a movement path of the pins of the conveyer.

The pushed-out coins are hooked by the pins provided in the endless proceed member, and conveyed along the guide. Thus, the coin is forced to move on the movement path of the pins, which ensures that the coin is transferred to the conveyer. In the process of this conveyance, the coins are separated by denomination in the first separating section or the second separating section. This ensures that the coins are separated by denomination.

A coin processing apparatus which sorts coins of a plurality of denominations one by one by a delivery device to deliver the coins, and then transfers the coins to a conveyer, and separates the coins by denomination in a coin separating section disposed on a conveyer path of the conveyer, characterized in that the conveyer path has a first separating section extending linearly substantially in a horizontal direction from the delivery device; and a second separating section extending successively from the first separating section in an opposite direction above the first separating section, and in that the conveyer path has a toppled U shape as a whole, and in that a lowermost portion of the second separating section is disposed above the delivery device, and wherein a guide device is provided to guide the coin which has reached a lowermost portion of the conveyer path to the delivery device.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
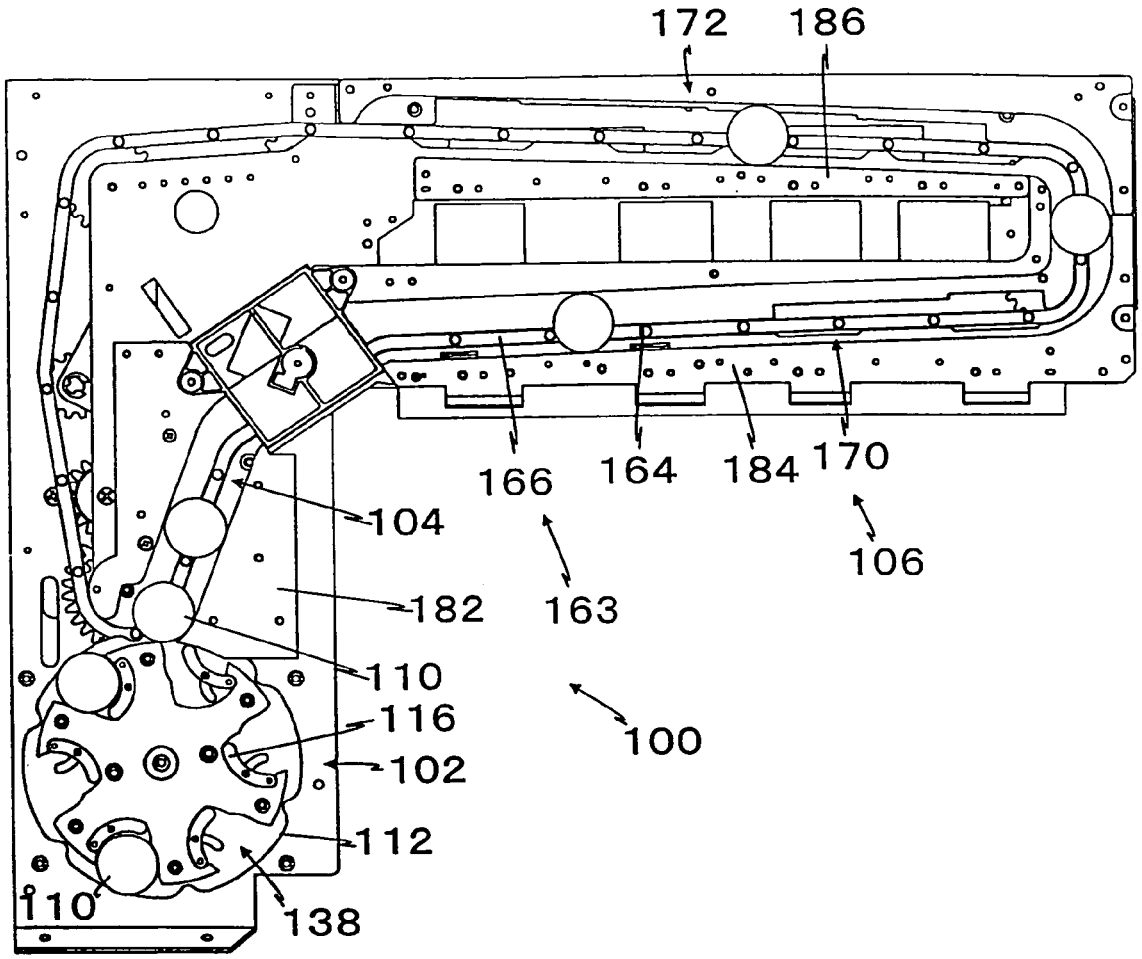
FIG. 1 is a schematic front view of a coin delivery device in an embodiment of the present invention.

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

The present embodiment concerns a coin processing apparatus which as shown can separate coins of eight denominations in English currency: 2 pounds (average diameter 28.5 mm (similarly in the following), 1 pound (22.5 mm), 50 pence (27.3 mm), 20 pence (21.4 mm), 10 pence (24.5 mm), 5 pence (17.9 mm), 2 pence (26 mm) and 1 penny (20.3 mm).

However, the present invention can also be used for coins of other countries.

In FIG. 1, a coin processing apparatus 100 includes a coin delivery device 102, a coin conveyer 104 and a coin screening device 106. That is, the coin delivery device 102 sorts and delivers coins 110 one by one to transfer them to the coin conveyer 104, and the coin screening device 106 separates the coins by denomination while they are being conveyed on a predetermined path by the coin conveyer 104.

First, the coin delivery device 102 will be described referring to FIG. 3 and FIG. 4. The coin delivery device 102 has a function to sort mixed coins of a plurality of denominations one by one for delivery. The coin delivery device 102 includes a rotary disk 112, a concave portion 114 formed between protruding portions 122, a moving member 116 to move the coin 110, and a driver 117 for the moving member.

A rotary disk 112 has a function to stir a large number of coins and to receive the coins 110 in concave portions 138 described later, one by one for sorting. The rotary disk 112 has a shape of a circular plate, is disposed such that its rotation axis line 118 is inclined at a predetermined angle, and has an upward surface 120.

It has six radially extending protruding portions 122 in the upward surface 120, and a push-out disk 126 is fixed in which the concave portions 114 are formed between the protruding portions 122. A slightly concave coin pushing portion 128 is formed on a front surface of the protruding portion 122 in a rotation direction of the rotary disk 112. A concave moving member receiving portion 130 is formed in a rear surface, in the rotation direction, of the protruding portions 122, where the arc-shaped moving member 116 is disposed. The rotary disk 112 and the push-out disk 126 can be integrally molded by a sintered metal or a resin having antifriction properties.

Next, the moving member 116 will be described.

The moving member 116 has a function to move, at a predetermined position, the coin 110 held in the sorting concave portion 138 in the diametrical direction of the rotary disk 112. The moving member 116 forms a perimeter portion of the indentation and a contact surface for the coin. The moving member 116 can have an alternative configuration as long as this function is satisfied.

The moving member 116 is attached, in a manner to be able to pivot, to a pivot shaft 134 protruding at the moving member receiving portion 130 on a peripheral edge side of the rotary disk 112. This moving member 116 is preferably made of a metal or a resin in view of antifriction properties and mechanical strength.

The concave portion 114 and an internal edge 136 of the moving member 116 constitute the fan-shaped sorting concave portion 138. The concave portion 138 is a flat ditch opening on an upper surface and peripheral surface sides. The depth of the concave portion 138, in other words, the thickness of the push-out disk 126 is formed to be slightly smaller than the thickness of the thinnest coin among those of eight denominations described above.

It is intended that two coins are not to be held on top of the other. Furthermore, the concave portion 138 is fan-shaped or arc-shaped at it's radially inward most position and the distance between an internal surface 140 of a retention ring 140 described later and a deepest portion of the concave portion 138 is twice or less than the diameter of a minimum diameter coin, such that two minimum diameter coins are not held side by side in the concave portion 138.

This is because the length in the circumferential and diametrical direction of the concave portion 138 is less than twice the minimum diameter coin. When the moving member 116 is positioned in the receiving portion 130, it is positioned at a receiving position RP. The rotary disk 112 is disposed at the bottom of the cylindrical retention ring 140 to retain the coin.

An opening 142 is provided at a portion of the retention ring 140 for transfer to the conveyer 104 so that the coin 110 can pass through. A retention bowl 144 is further attached to the retention ring 140, and a retention portion 146 is provided opposite to the rotary disk 112. Therefore, the coin 110 thrown in this retention portion 146 is guided toward the rotary disk 112.

Next, the driver 117 of the moving member 116 will be described. The driver 117 has a function to move, at a predetermined position, the moving member 116 from the receiving position RP to a moving position MP. Therefore, the configuration of the driver 117 can be changed to configurations other than that in the embodiment as long as this function is satisfied. The driver 117 includes a moved member 154 and a cam 157 to form an activator unit.

An arc-shaped through-hole or eject cam path 148 is formed around the pivot shaft 134 in the rotary disk 112, through which a pin or follower 150 fixed at the midpoint of the moving member 116 is penetrated A roller 152 is rotably attached to a lower end of the pin 150. This roller 152 is the moved member 154.

Next, the cam 157 will be described. The moved member or follower 154 is movably inserted in an endless groove cam 158 formed in an upper surface of an inward flange 156 formed in a ring shape from the inner peripheral surface toward the center of the retention ring 140.

Figure 3:
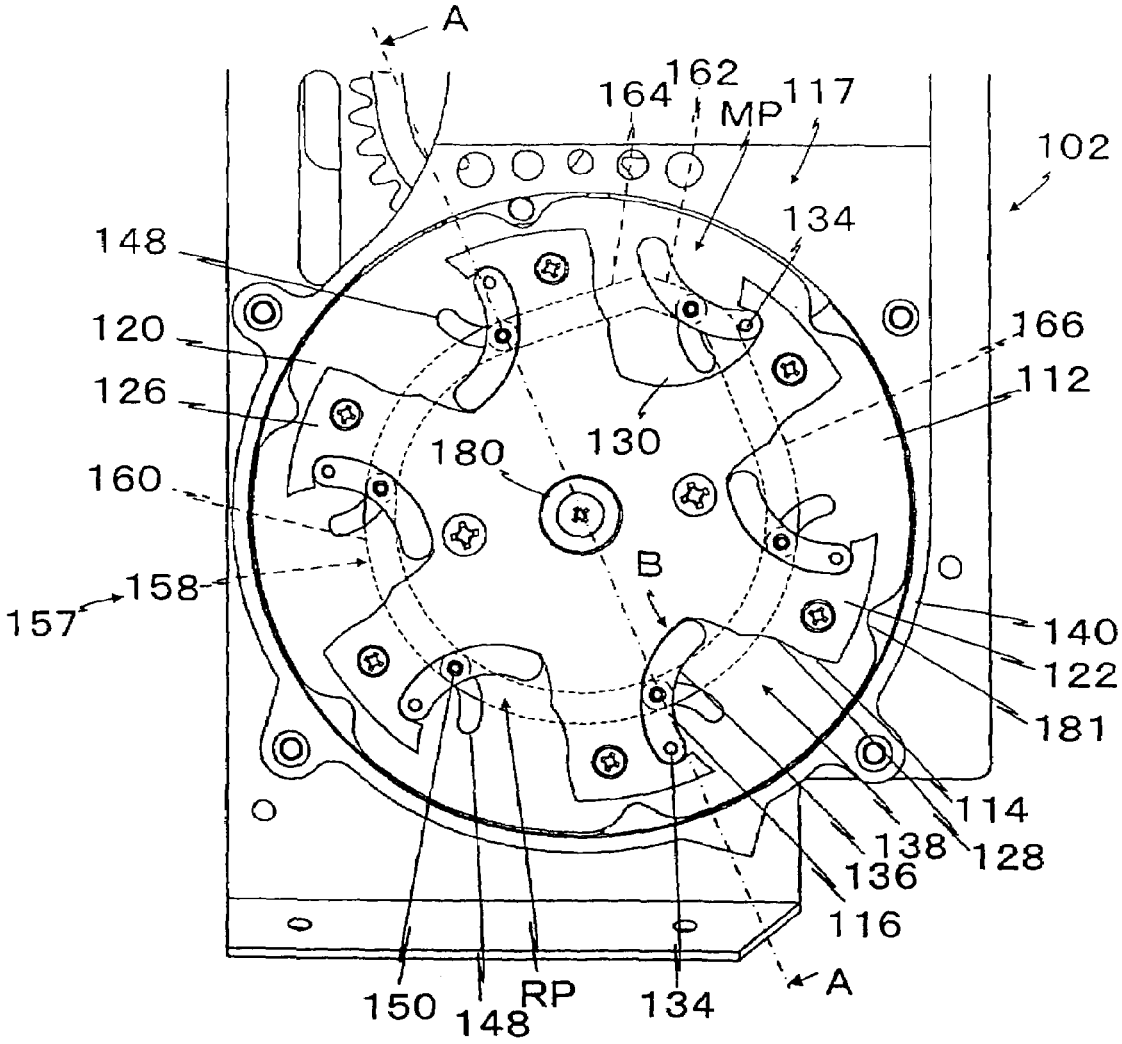
FIG. 3 is a front view of the coin delivery device in the embodiment of the present invention.
Figure 4:
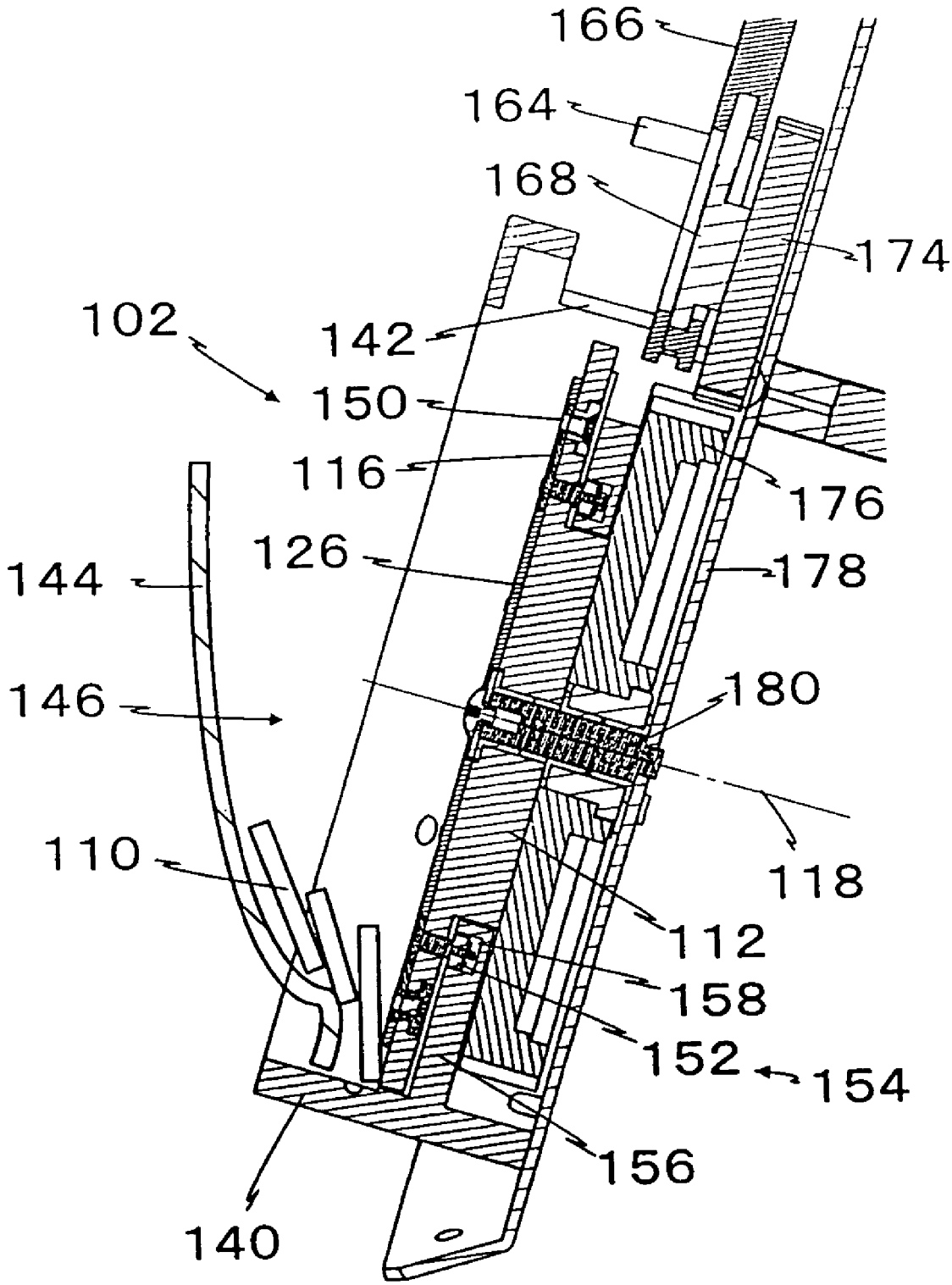
FIG. 4 is a sectional view along the line A-A in FIG. 3.

The endless groove cam 158, includes a concentric circular receiving groove 160 around a rotation center of the rotary disk 112; a moving groove 162 which has a larger diameter than that of the receiving groove 160 and which holds the moving member 116 at the moving position MP; a coin deliver process groove 164 in the process of moving from the receiving groove 160 to the moving groove 162; and a return process groove 166 returning from the moving groove 162 to the receiving groove 160 as shown in FIG. 3.

Figure 5:
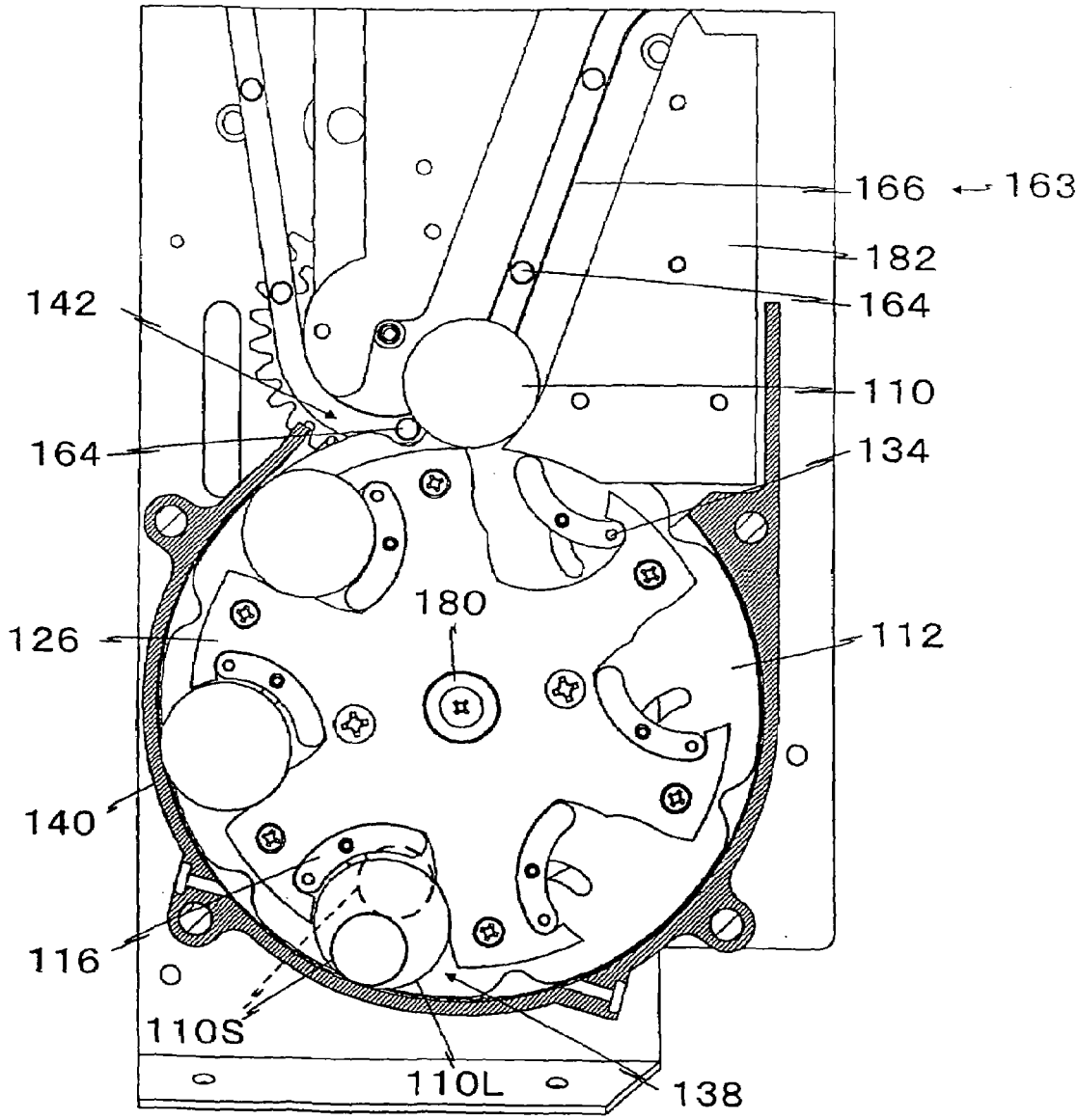
FIG. 5 is a front view to explain the operation in the embodiment of the invention.

Therefore, when the moved member 154 is positioned in the receiving groove 160, the moving member 116 is held in the receiving portion 130, and is at the receiving position RP. Thus, the moving member 116 forms the fan-shaped sorting concave portion 138 together with the concave portion 114. As shown in FIG. 5, the sorting concave portion 138 is such that a bottom B (in the embodiment, the tip of the moving member 116) closest to a rotation shaft 180 is located slightly farther away from the internal surface of the retention ring 140 than the diameter of a maximum diameter coin 110L.

Furthermore, this distance is less than double the diameter of a minimum diameter coin 110S. Therefore, two minimum diameter coins 110S are not received side by side in the sorting concave portion 138, in other words, between the retention ring 140 and the bottom B, in the diametrical direction of the rotary disk 112.

Furthermore, the sorting concave portion 138 is fan-shaped, so that two minimum diameter coins 110 are not received side by side in the circumferential direction of the rotary disk 112. When the moved member 154 is positioned in the deliver process groove 164, the moving member 116 is caused to pivot clockwise on the pivot shaft 134.

Then, when the moved member 154 is positioned in the moving groove 162, the moving member 116 moves to the moving position MP. Subsequently, the moved member 154 is positioned at the return process groove 166, and the moving member 116 is thus rotated counterclockwise on the pivot shaft 134 and returned to the receiving position RP. Thus, the cam 157 is not limited to the groove cam 158, but when the groove cam 158 is used, an auxiliary device is not needed to move the moved member 154 along the cam 157, thereby providing advantages such as structural simplification, possible size reduction and low costs.

The coin conveyer 104 has a function to receive the coins 110 delivered one by one from the coin delivery device 102, and convey them to a predetermined coin processing apparatus, such as the coin screening device. The coin conveyer 104 includes an endless proceed member 163, and pins 164 attached at predetermined intervals to the endless proceed member 163.

The endless proceed member 163 is a flexible loop member, and can be a chain 166 having a predetermined length in the embodiment. However, the endless proceed member 163 can be changed to a belt. The endless proceed member 163 is guided by a plurality of sprockets, and circulates on an L-shaped loop path.

That is, the path of the endless proceed member 163 comes closest to the top of the rotary disk 112 at the lowest sprocket 168 portion, and then goes upward at a steep angle, and thus proceeds in a first screening portion 170 which is a gentle upward slope. Next, it proceeds substantially vertically, and then proceeds in a second screening portion 172 which is located above the first screening portion 170 and which is a gentle upward slope, and thus returns to the sprocket 168 portion.

Figure 2:
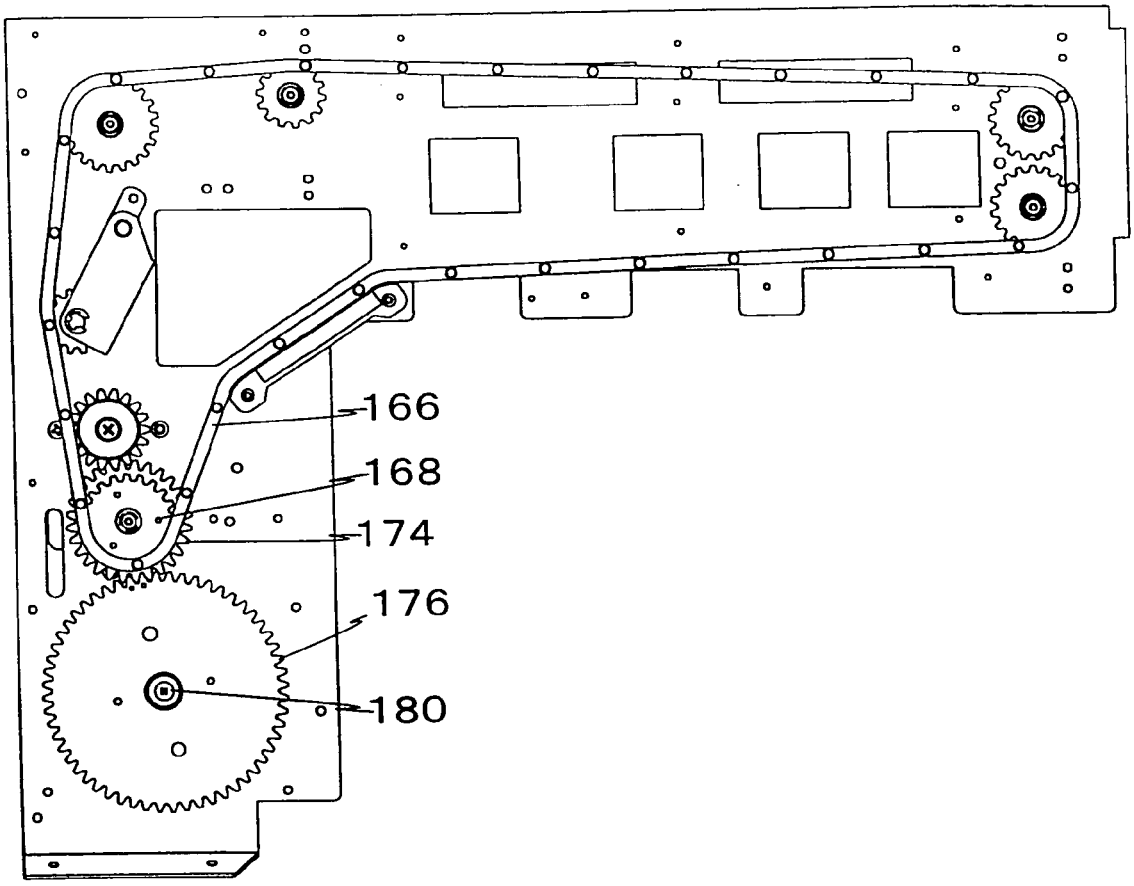
FIG. 2 is a schematic view of a conveyer of the coin delivery device in the embodiment of the present invention.

The pins 164 are fixed at predetermined intervals to a side surface of the endless proceed member 162 so as to hook the coins 110, one by one, delivered from the coin delivery device 102. Therefore, the sprocket 168 rotates in conjunction with the rotary disk 112. That is, a gear 174 to which the sprocket 168 is fixed engages with a gear 176 disposed under the rotary disk 112. In other words, the gear 176 is rotatably attached to a shaft 180 fixed to a base 178, and the rotary disk 112 is fixed to the gear 176. See FIG. 2. The gear 174 engages with a gear 182 on its side, and the gear 182 is driven by an unshown electric motor at a predetermined velocity.

Therefore, the rotary disk 112 and the sprocket 168 rotate and move at a predetermined velocity ratio. In other words, the sorting concave portion 138 moves in a corresponding manner to the pins 164. It is to be noted that a notch 181 is formed at an outer peripheral edge of the protruding portion 122 of the rotary disk 112 so that the transfer from the moving member 116 to the pin 164 is smoothly performed, and the pin 164 can enter the notch 181.

The first plate-shaped coin guide 182 is disposed along the endless proceed member 163 in the vicinity of the sprocket 168, and a second coin guide 184 is disposed along the first screening portion 170, and a third coin guide 186 is disposed along the second screening portion 172. Thus, the coin 110 hooked by the pin 164 is moved to a predetermined position by the endless proceed member 163 while being guided by these coin guides 182, 184, 186.

Next, the operation of the present embodiment will be described by referring to FIG. 5. When the coin 110 is thrown into the retention portion 146, it is moved to the rotary disk 112 side due to the inclination of the bowl 144, and contacts the rotary disk 112 and the push-out disk 126. The rotary disk 112 is automatically rotated by detecting the throwing of the coin, or is constantly rotating.

As seen in FIG. 3, the rotation of the rotary disk 112 causes the coins 110 to be stirred by the protruding portion 122 and to enter the sorting concave portions 138. At positions other than the position in the vicinity of the coin conveyer 104, the moving member 116 is positioned in the receiving portion 130, and is thus at the receiving position RP. In other words, the concave portion 138 is fan-shaped Therefore, only one coin 110 is held in the sorting concave portion 138 defined by the pushing portion 128 of the protruding portion 122 and by the arc-shaped surface of the moving member 116. That is, the outer periphery of the coin 110 is guided by the retention ring 140, so that only one maximum diameter coin 110 is held in the concave portion 138 which is formed slightly more deeply than the diameter of the maximum diameter coin 110L.

Furthermore, as its depth is less than double the diameter of the minimum diameter coin 110, two minimum diameter coins 110S cannot enter in the diametrical direction of the rotary disk 112. Moreover, the concave portion 138 is fan-shaped, so that two minimum diameter coins 110 cannot be arranged side by side in the circumferential direction of the rotary disk 112. Therefore, only one minimum diameter coin 110S is held in the sorting concave portions 138. The rotation of the rotary disk 112 causes the coin 110 held in the concave portion 138 to move to the conveyer 104 side. In other words, the coin 110 is moved upward.

At this point, the coin 110 is pushed and moved by the pushing portion 128, and almost no force is applied to the moving member 116. When the moving member 116 has moved near the coin conveyer 104, the moved member 154 moves the deliver process member 164, so that the moved member 154 is moved in the diametrical direction of the rotary disk 112.

Thus, the moving member 116 is caused to pivot clockwise on the pivot shaft 134. Therefore, the moving member 116 pushes the coin 110 positioned in the receiving concave portion 138 from the lateral side in the diametrical direction of the rotary disk 112, thereby pushing out the coin 110 from the receiving concave portion 138.

Then, when the moved member 154 is positioned in the moving groove 162, the moving member 116 moves to the moving position MP, so that the coin 110 passes through the opening 142 and is pushed out to the moving path of the pin 164. Immediately after being pushed out, the coin 110 is pushed by the pin 164, and guided by the first coin guide 182, the second coin guide 184, the third coin guide 186 and the like, thus being conveyed to the subsequent process.

The present invention can be used for a coin delivery device which moves, at a predetermined position, a coin to a predetermined position. Therefore, it has been used to transfer the coin to a coin conveyer in the embodiment described above, but the present invention can also be employed for the coin delivery device to dispense the coins one by one at a predetermined position, a so-called coin hopper.

Figure 6:
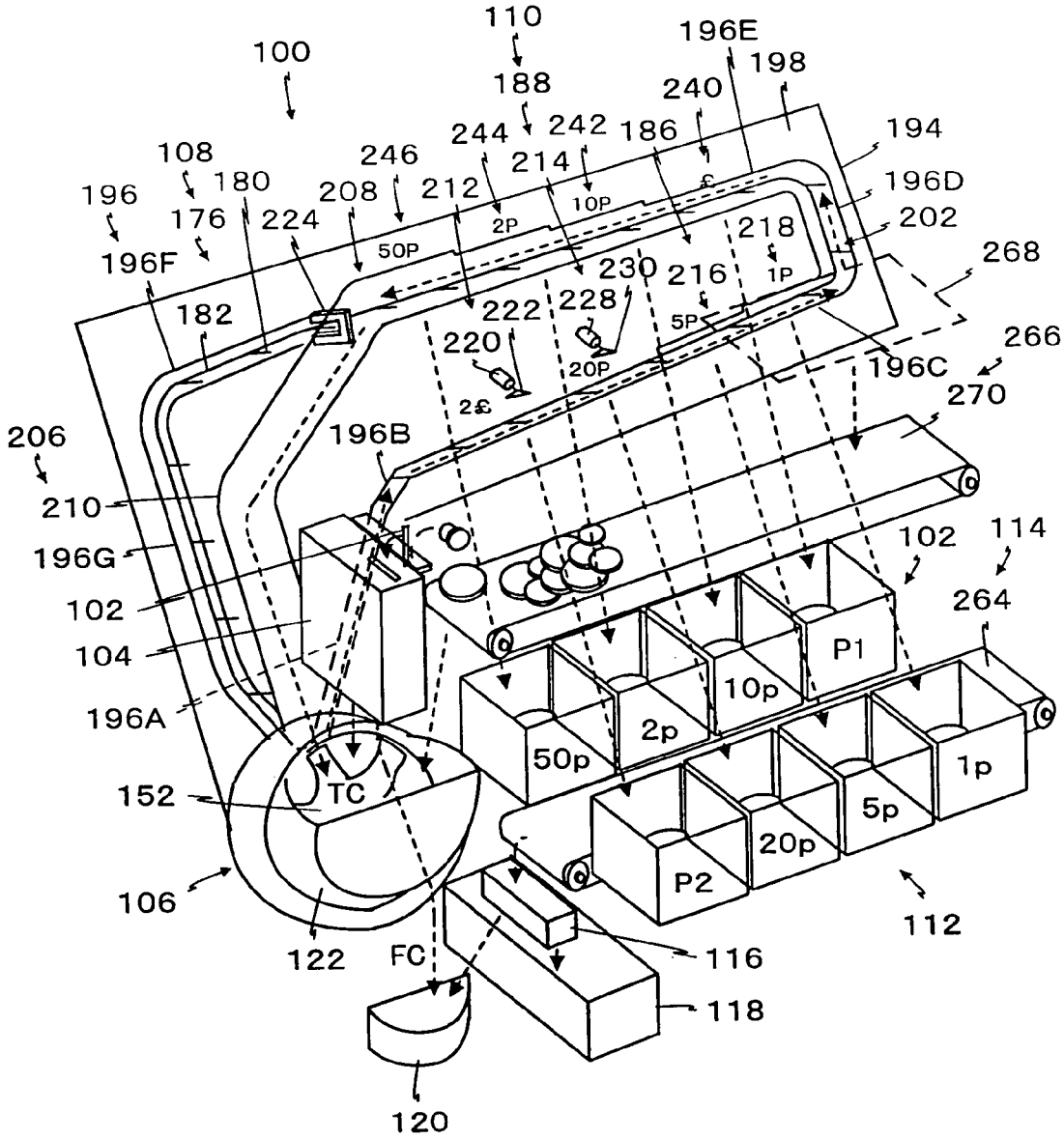
FIG. 6 is a schematic perspective view of a coin processing apparatus in an embodiment of the present invention.

FIG. 6 is another example of a coin processing apparatus 100 with which a customer can make a self-service payment at a supermarket. The coin processing apparatus 100 roughly includes a coin slot 102, a coin selector 104, a coin delivery device 106, a coin conveyer 108, a coin separating section (device) 110, a coin retention section 112, a dispensed coin conveying section 114, a dispensed coin allotting section 116, an overflow coin safe 118 and a coin dispensing section 120.

The coin slot 102 has a function to receive coins thrown in by the customer. The coin slot 102 in the embodiment is formed into a longitudinally long rectangular slit to receive the coins one by one. However, the coin slot 102 may be changed to a bowl-shaped receiving container, so that the coins in bulk are received, and then divided one by one by a known division device, and thus thrown in the coin selector 104 described later.

The coin selector 104 is disposed under the coin slot 102, and has a function to judge the truth and denomination of a coin C received from the coin slot 102 and divides a false coin from a true coin. In the coin selector 104 of the embodiment, a false coin FC is returned to the bowl-shaped coin dispensing section 120 by way of an unshown chute. A true coin TC is guided into a retention bowl 122 of the coin delivery device 106 by the unshown chute.

Therefore, the coin selector 104 can adopt one of an electric method in which a plurality of oscillation coils is used to detect the material, diameter and thickness of the coin to compare them with reference values, an image method in which a pattern on the surface of the coin is taken in as an image by a CCD camera or the like to compare it with a reference value, or a sound wave method in which a shock is given to the coin to compare sound waves emitted from the coin with a reference value.

Figure 7:
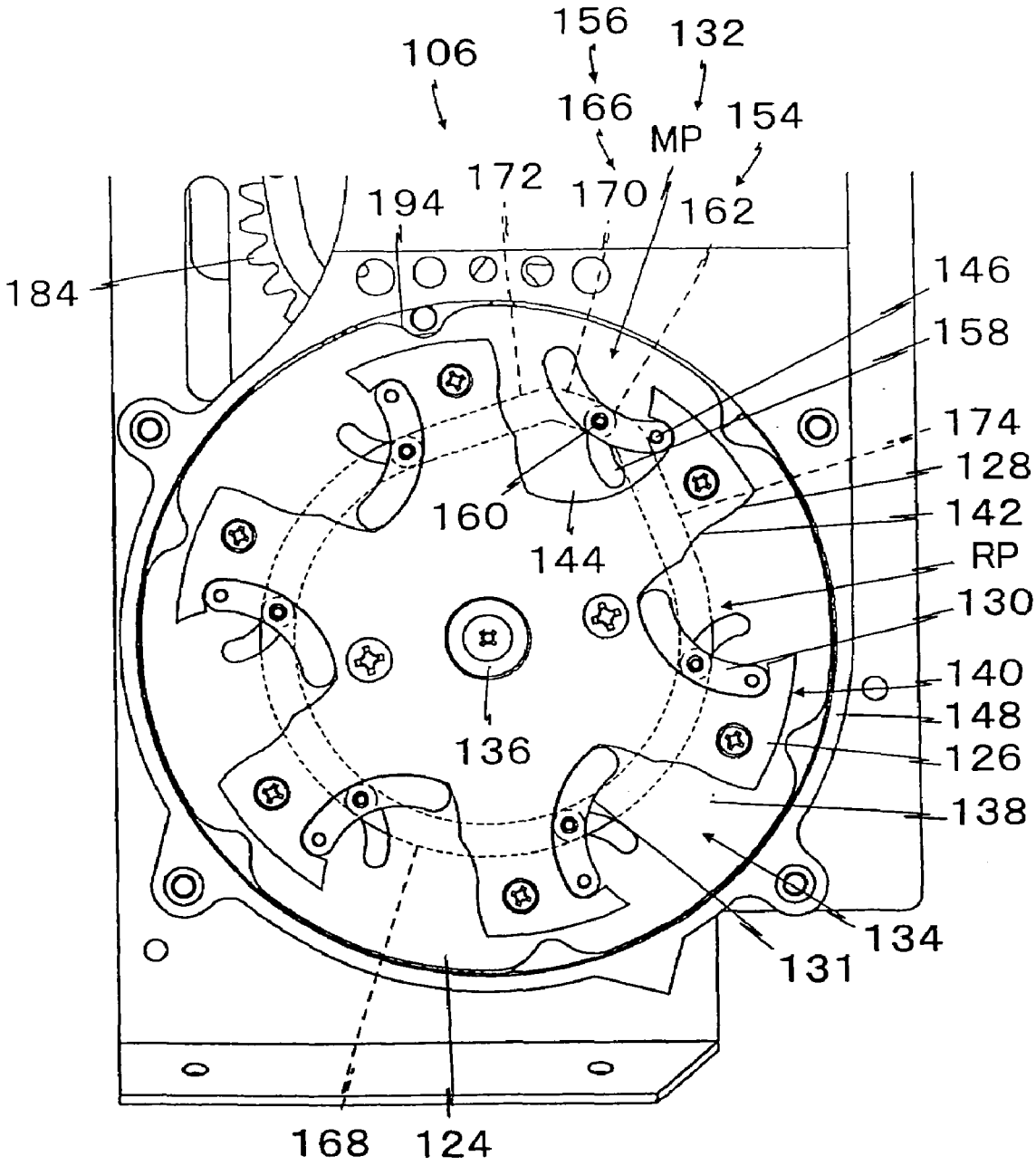
FIG. 7 is a schematic front view of a coin delivery device in the embodiment of the present invention.

The coin delivery device 106 has a function to sort the mixed coins of a plurality of denominations one by one for delivery. Therefore, the coin delivery device 106 can be changed to other devices having a similar function The coin delivery device 106 in the embodiment includes a rotary disk 124, a concave portion 128 formed between protruding portions 126, a moving member 130 to move the coin, and a driver 132 for the moving member 130, as shown in FIG. 7.

The rotary disk 124 has a function to stir a large number of coins and to receive the coins in sorting concave portions 134 described later one by one for sorting. The rotary disk 124 has a shape of a circular plate, has its rotation axis 136 inclined at about 30 degrees, and includes an upward surface 138. It has six radially extending protruding portions 126 in the upward surface 138, and a push-out disk 140 is fixed in which the concave portions 128 are formed between the protruding portions 126.

A slightly concave coin pushing portion 142 is formed on a front surface of the protruding portion 126 in a rotation direction of the rotary disk 124. A concave moving member receiving portion 144 is formed in a rear surface, in the rotation direction, of the protruding portions 126, where the arc-shaped moving member 130 is disposed. The rotary disk 124 and the push-out disk 140 can be integrally molded by a sintered metal or a resin having antifriction properties.

The moving member 130 has a function to move, at a predetermined position, the coin C held in the sorting concave portion 134 in a diametrical direction of the rotary disk 124. Therefore, the moving member 130 can have an alternative configuration as long as this function is satisfied. The moving member 130 is attached, in a manner to be able to pivot, to a pivot shaft 146 protruding at the moving member receiving portion 144 on a peripheral edge side of the rotary disk 124. This moving member 130 is preferably made of a metal or a resin in view of antifriction properties and mechanical strength.

The concave portion 128 and an internal edge 131 of the moving member 130 constitute the fan-shaped sorting concave portion 134. The concave portion 134 is a flat ditch opening on an upper surface and peripheral surface sides.

The depth of the concave portion 134, in other words, the thickness of the push-out disk 140 is formed to be slightly smaller than a thickness of 1.5 mm of the thinnest one-penny coin among those of eight denominations described above. This is intended so that two coins are not held on top of the other.

Furthermore, the concave portion 134 is fan-shaped and the distance between an internal surface of a retention ring 148 and a deepest portion of the concave portion 134 is twice or less than a minimum diameter of 17.9 mm of a 5-pence coin, such that two 5-pence coins are not held side by side in the concave portion 134. This is because the length in the circumferential and diametrical direction of the concave portion 134 is less than twice the diameter of the 5-pence coin.

When the moving member 130 is positioned in the receiving portion 144, the moving member 130 is positioned at a receiving position RP. The rotary disk 124 is disposed at the bottom of the cylindrical retention ring 148 to retain the coin.

An opening 150 is provided at a portion of the retention ring 148 for transfer to the conveyer 108 so that the coin C can pass through. A retention bowl 122 is further attached to the retention ring 148, and a retention section 152 is provided opposite to the rotary disk 124. Therefore, the coin C thrown in this retention section 152 is guided toward the rotary disk 124.

Next, the driver 132 of the moving member 130 will be described.

The driver 132 has a function to move, at a predetermined position, the moving member 130 from the receiving position RP to a moving position MP. Therefore, the configuration of the driver 132 can be changed to configurations other than that in the embodiment as long as this function is satisfied. The driver 132 includes a moved member 154 and a cam 156.

First, the moved member 154 will be described.

An arc-shaped through-hole 158 is formed around the pivot shaft 146 in the rotary disk 124, through which a pin 160 fixed at the midpoint of the moving member 130 is penetrated. A roller 162 is rotatably attached to a lower end of the pin 160. This roller 162 is the moved member 154.

Next, the cam 156 will be described. The moved member 154 is movably inserted in a groove cam 166 formed in an upper surface of an inward flange 164 formed in a ring shape from the inner peripheral surface toward the center of the retention ring 148.

In the groove cam 166, there are formed a circular receiving groove 168 around a rotation center of the rotary disk 124; a movement groove 170 which has a larger diameter than that of the receiving groove 168 and which holds the moving member 130 at the moving position MP; a deliver process groove 172 in the process of moving from the receiving groove 168 to the movement groove 170; and a return process groove 174 returning from the movement groove 170 to the receiving groove 168.

Therefore, when the moved member 154 is positioned in the receiving groove 168, the moving member 130 is held in the receiving portion 144, and is at the receiving position RP. The moving member 130 forms the fan-shaped sorting concave portion 134 together with the concave portion 128. The sorting concave portion 134 is such that a bottom (in the embodiment, the tip of the moving member 130) closest to a rotation shaft 136 is located slightly farther away from the internal surface of the retention ring 148 than the diameter of the maximum diameter coin. Furthermore, this distance is less than double the diameter of the minimum diameter coin.

Therefore, two minimum diameter coins are not received side by side in the sorting concave portion 136, in other words, between the retention ring 148 and the bottom, in the diametrical direction of the rotary disk 124.

Furthermore, the sorting concave portion 134 is fan-shaped, so that two minimum diameter coins are not received side by side in the circumferential direction of the rotary disk 130. When the moved member 154 is positioned in the deliver process groove 172, the moving member 130 is caused to pivot clockwise on the pivot shaft 146. Then, when the moved member 154 is positioned in the movement groove 170, the moving member 130 moves to the moving position MP.

Subsequently, the moved member 154 is positioned at the return process groove 174, and the moving member 130 is thus rotated counterclockwise on the pivot shaft 146 and returned to the receiving position RP.

Thus, the cam 156 is not limited to the groove cam 166, but when the groove cam 166 is used, an auxiliary device is not needed to move the moved member 154 along the cam 156, thereby providing advantages such as structural simplification, possible size reduction and low costs.

Next, the coin conveyer 108 will be described. The coin conveyer 108 has a function to receive the coins C delivered one by one from the coin delivery device 106, and convey them to a predetermined coin processing apparatus, such as the coin separating section 110. The coin conveyer 108 includes an endless proceed member 176, pins 180 attached at predetermined intervals to the endless proceed member 176, and a guide plate 194 to guide the coin C while causing it to lean thereon.

Figure 12:
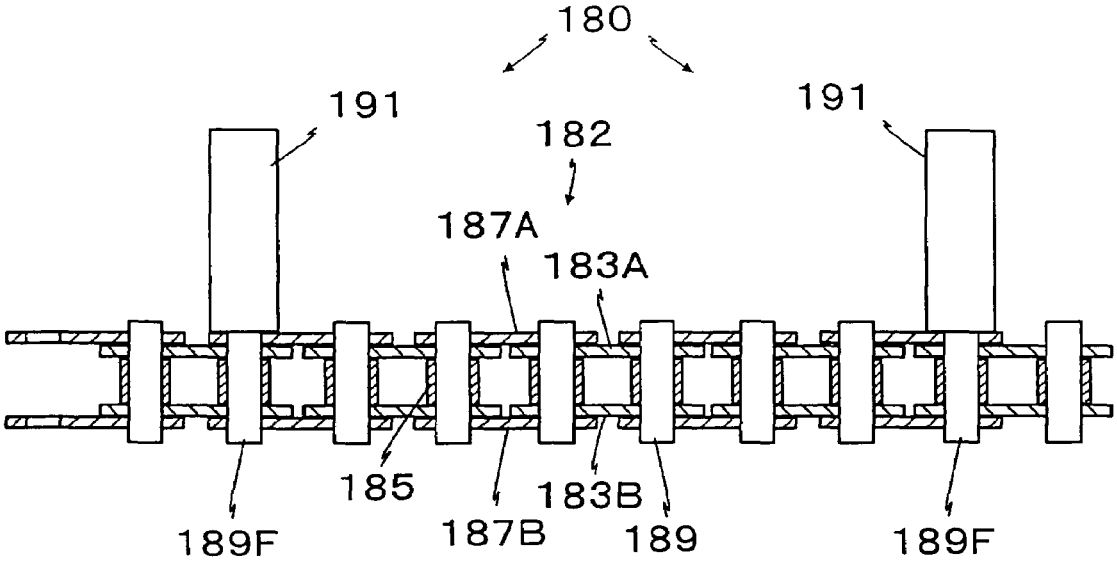
FIG. 12 is a schematic view of the pin and socket chain.

The endless proceed member 176 is a flexible loop member, and is a chain 182 having a predetermined length in the present embodiment as shown in FIG. 12. However, the endless proceed member 176 can be changed to a belt. The chain 182 is guided by a plurality of unshown sprockets, and circulates on an L-shaped loop path.

Figure 8:
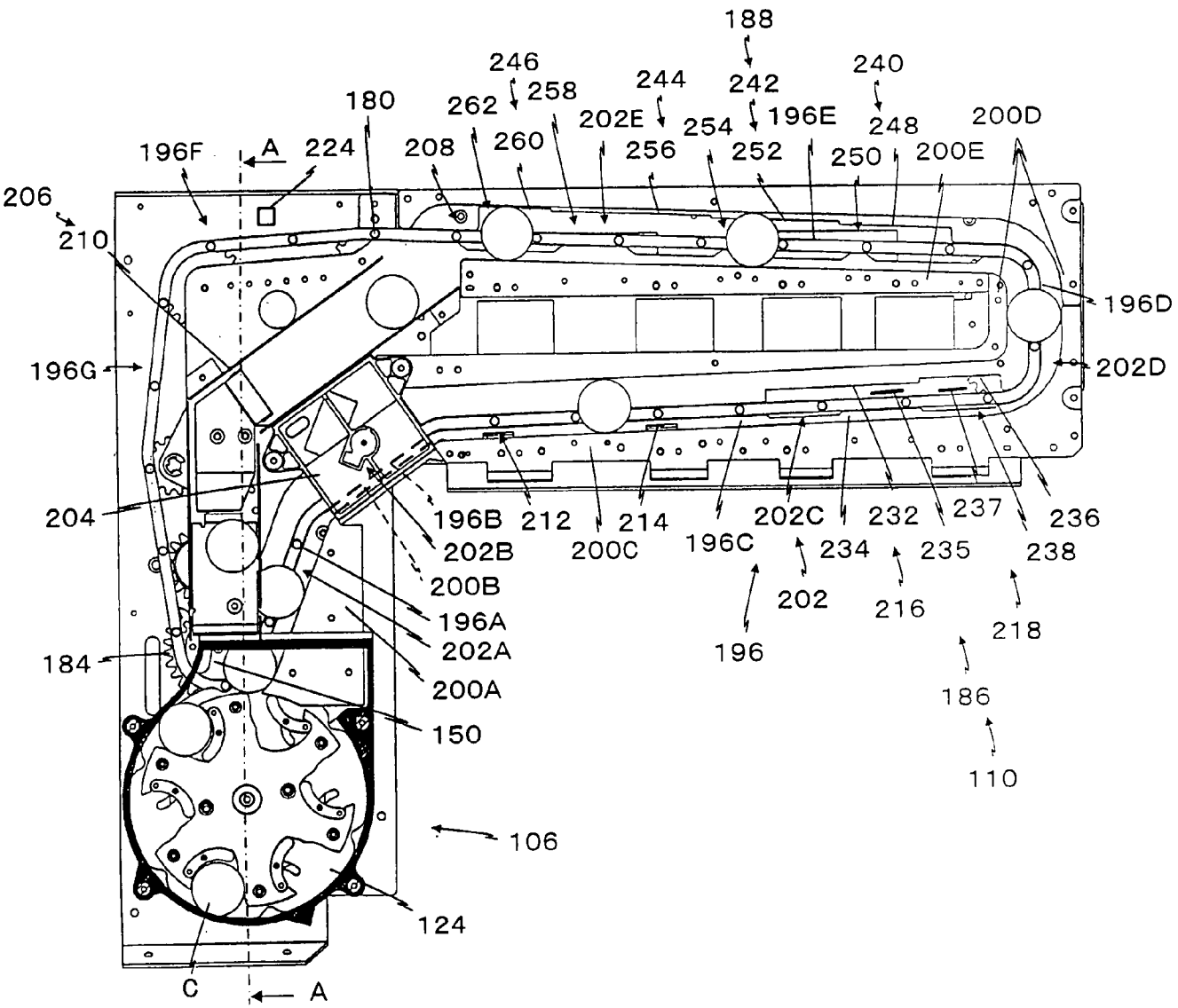
FIG. 8 is a schematic view of a conveyer of the coin processing apparatus in the embodiment of the present invention.

As shown in FIG. 8, the path of the chain 182 comes closest to the top of the rotary disk 124 at a lowest sprocket 184 portion adjacent to the rotary disk 124, and then goes upward at a steep angle, and thus proceeds in a first separating section 186 which is a gentle upward slope. Next, it proceeds substantially vertically, and then proceeds in a second separating section 188 which is located above the first separating section 186 and which is a gentle upward slope, and thus descends substantially vertically to return to the sprocket 184 portion.

The pins 180 are fixed at predetermined intervals to a side surface of the endless proceed member 182 so as to hook the coins C, one by one, delivered from the coin delivery device 106.

Figure 9:
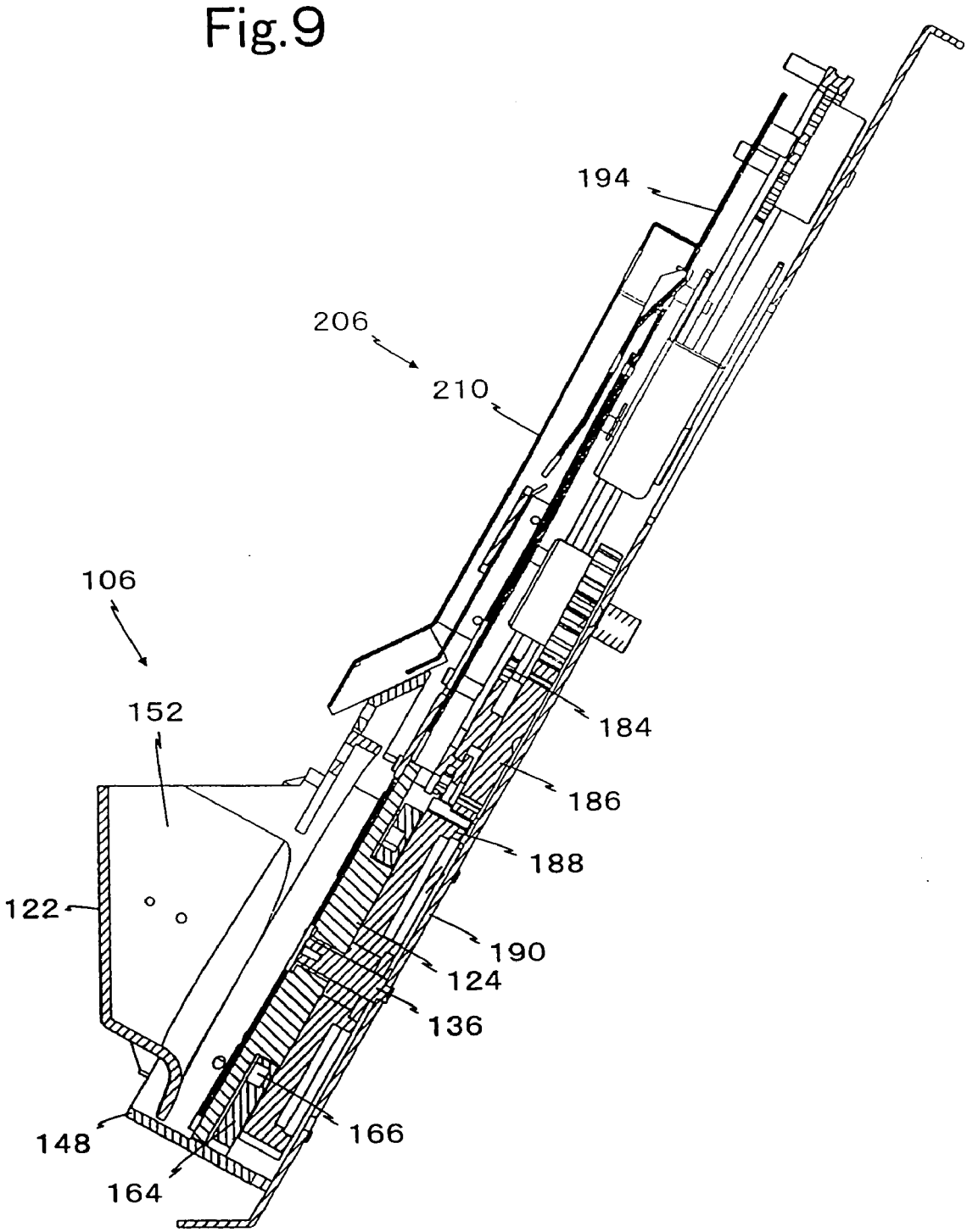
FIG. 9 is a sectional view along the line A-A in FIG. 8.

Therefore, the sprocket 184 rotates in conjunction with the rotary disk 124. As shown in FIG. 9, a gear 186 to which the sprocket 184 is fixed engages with a gear 188 disposed under the rotary disk 124. In other words, the gear 188 is rotatably attached to the shaft 136 fixed to a base 190, and the rotary disk 124 is fixed to the gear 188. The gear 188 engages with a gear 186 on its side, and the gear 188 is driven by an unshown electric motor at a predetermined velocity. Therefore, the rotary disk 124 and the sprocket 184 rotate and move at a predetermined velocity ratio. In other words, the sorting concave portion 134 moves in a corresponding manner to the pins 180.

It is to be noted that a notch 194 is formed at an outer peripheral edge of the protruding portion 126 of the rotary disk 124 so that the transfer from the moving member 130 to the pin 180 is smoothly performed, and the pin 180 can enter the notch 194.

The guide plate 194 is an L-shaped plate which is inclined similarly to the rotary disk 124 of the coin delivery device 106. A movement groove 196 is formed in a loop shape in the guide plate 194 for the pins 180 fixed to the chain 182 to move.

In other words, the endless proceed member 176 is disposed on a rear surface side of the guide plate 194.

The shape of the movement groove 196 will be described starting from the sprocket 184 portion adjacent to the coin delivery device 106 with reference to FIG. 8. The movement groove 196 includes a first movement groove 196A sharply rising obliquely, a second movement groove 196B rising at an angle of about 45 degrees, a third movement groove 196C which is a slightly upward slope, a fourth movement groove 196D extending vertically, a fifth movement groove 196E which is located above the third movement groove 196C and which is a slightly upward slope toward the first movement groove 196A side, a sixth movement groove 196F extending substantially in a horizontal direction, and a seventh movement groove 196G vertically extending downward to the sprocket 184, and the movement groove 196 assumes a horizontally-oriented L shape as a whole.

A plate-shaped coin guide is disposed on an upward surface 198 side of the guide plate 194, and guides the peripheral surface of the coin C moved by the endless proceed member 176. That is, a first coin guide 200A is disposed relative to a lower side of the first movement groove 196A; a second coin guide 200B is disposed relative to a lower side of the second movement groove 196B; a third coin guide 200C is disposed relative to a lower side of the third movement groove 196C; a fourth coin guide 200D is disposed relative to both right and left sides of the fourth movement groove 196D; and a fifth coin guide 200E is disposed relative to a lower side of the fifth movement groove 196E.

The plate thickness of the first coin guide 200A, the second coin guide 200B and the fourth coin guide 200D is set slightly larger than the thickest coin. Specifically, it is set slightly larger than the thickness of the thickest 2-pound coin.

In this way, the coin C pushed by the pins 180 does not drop from these coin guides.

The plate thickness of the third coin guide 200C and the fifth coin guide 200E is set slightly larger than the thinnest coin. Specifically, it is set slightly larger than the thickness of the thinnest 1-penny coin. In this way, the moved coin C easily drops from the coin guide 200C, 200E. Therefore, the coins C sorted and delivered one by one from the coin delivery device 106 are hooked by the pins 180 to move on a conveyer path 202.

In particular, the coin C is conveyed and moved sequentially on a first conveyer path 202A under the guidance of the first coin guide 200A, a second conveyer path 202B under the guidance of the second coin guide 200B, a third conveyer path 202C under the guidance of the third coin guide 200C, a fourth conveyer path 202D under the guidance of the fourth coin guide 200D, and a fifth conveyer path 202E under the guidance of the fifth coin guide 200E.

A denomination sensor 204 is disposed on the second conveyer path 202B. The denomination sensor 204 has a function to differentiate the 2-pound coin from the 20-pence coin in the present embodiment, and for example, a judgment is made by identifying the diameter and material from data sensed by a plurality of oscillation coils.

Next, a guide device 206 of the present invention will be described.

The guide device 206 has a function to guide the coin C which has reached a terminal end of the fifth conveyer path 202E, in other words, a lowermost portion 208 of the conveyer path 202, to the coin delivery device 106.

In the embodiment, there is provided a cylindrical chute 210, see FIG. 9, to guide the coin C from the lowermost portion 208 of the fifth conveyer path 202E located above the coin delivery device 106 to the retention bowl 122 of the coin delivery device 106 as shown on FIG. 8. That is, the coin C slips down by its own weight in the chute 210, and drops in the retention section 152 of the coin delivery device 106.

Therefore, the coins C which have not been separated by the coin separating device 110 are returned to the coin delivery device 106 from the fifth conveyer path 202E by way of the chute 210, and transferred again from the coin delivery device 106 to the conveyer 108. As a result, they are separated in the separating portions of the predetermined denominations or continue circulation.

The coin separating device 110 has a function to separate by denomination the coins conveyed along the conveyer path 202 by the coin conveyer 108. The first separating section 186 is provided along the third conveyer path 202C. That is, in the first separating section 186, a 2-pound separating portion 212, a 20-pence separating portion 214, a 5-pence separating portion 216 and a 1-penny separating portion 218 are sequentially arranged from an upstream side to a downstream side in a traveling direction of the endless proceed member 176.

Figure 13:
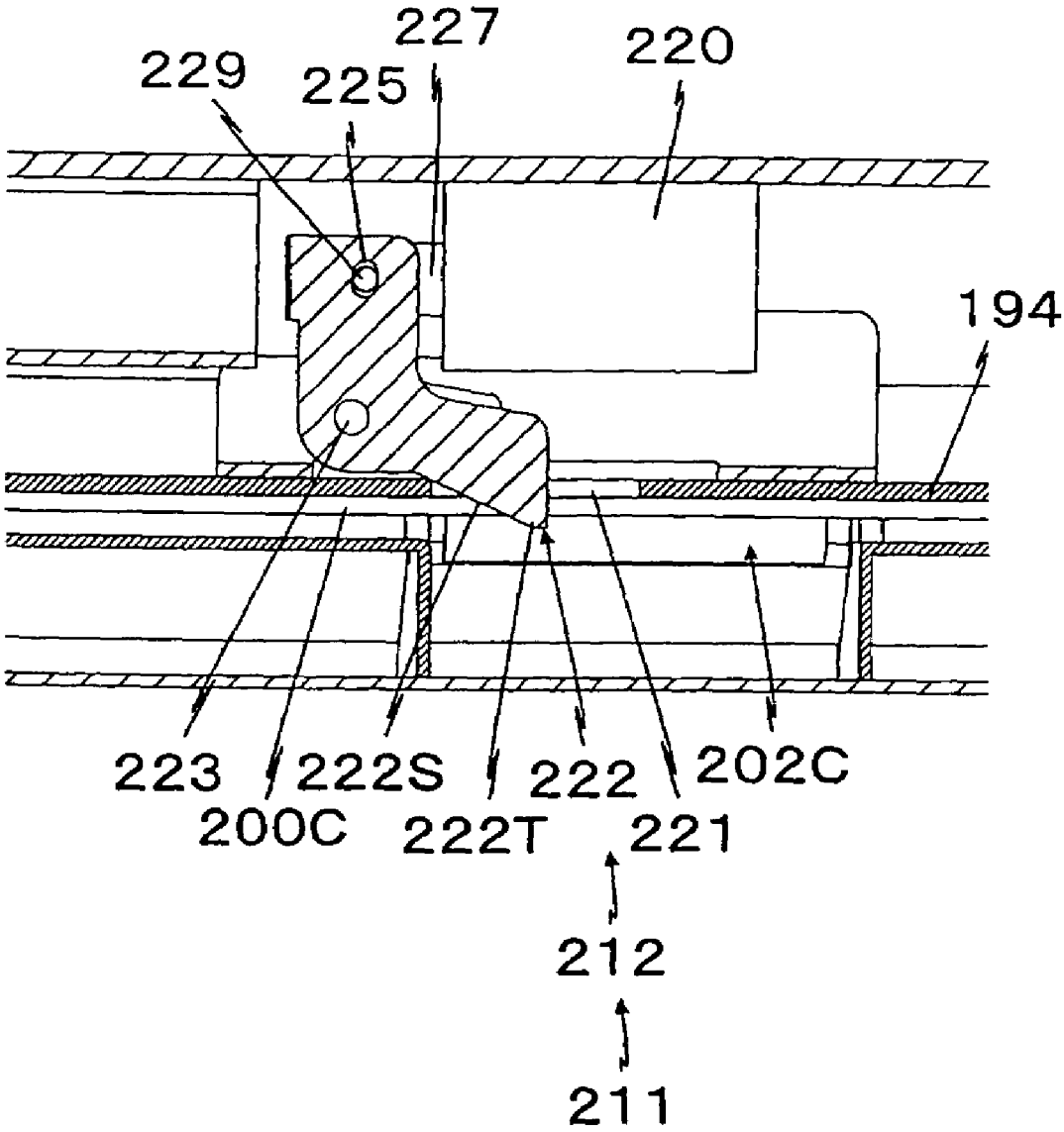
FIG. 13 is a cross sectional view of a separating portion.

The 2-pound separating portion 212 shown in FIG. 13 comprises a triangular warped plate 222 which is projected by a solenoid 220 at a predetermined time on the third conveyer path 202C between the third coin guide 200C and the movement path of the pins 180.

Figure 14:
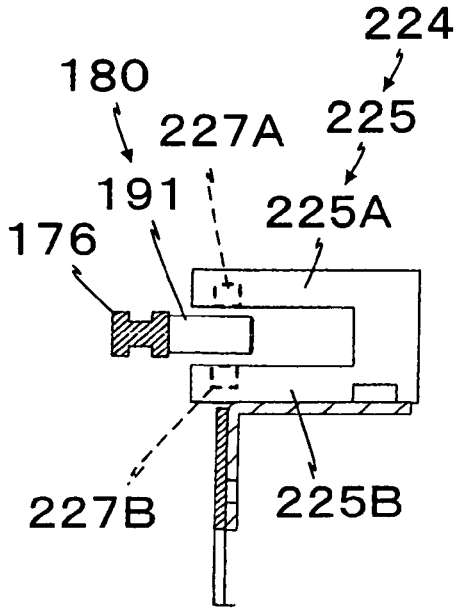
FIG. 14 is a cross sectional schematic view of the timing sensor.

After detecting the 2-pound coin by the denomination sensor 204, the solenoid 220 is excited for a predetermined time period when a predetermined number of pulse signals are received, for example, one pulse signal is output from a timing sensor 224 which detects each of the pins 180 as shown in FIG. 14.

As the excitation of the solenoid 220 shown in FIG. 6 causes the warped plate 222 to project on the third conveyer path 202C, the 2-pound coin moving on the third conveyer path 202C is moved so that its tip moves away from the guide plate 194 due to the inclined surface of the warped plate 222, thereby dropping downward off from the third coin guide 200C. The dropped 2-pound coin is guided to a retention bowl of a 2-pound coin hopper P2 described later under the guidance of an unshown chute. The 20-pence selecting portion 214 comprises a solenoid 228 and a warped plate 230 similarly to the 2-pound separating portion 212. After detecting the 20-pence coin by the denomination sensor 204, the solenoid 228 is excited for a predetermined time when two pulse signals are output from the timing sensor 224.

Figure 15:
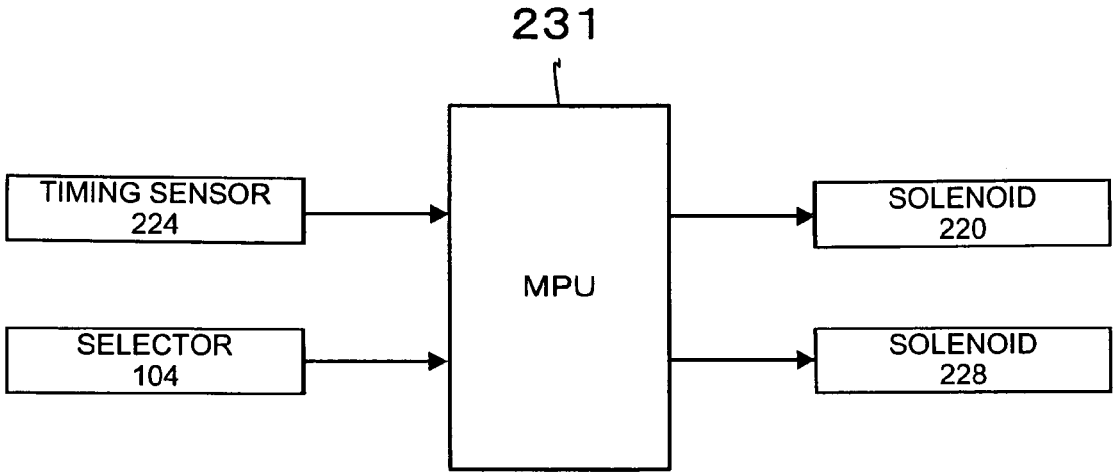
FIG. 15 is a schematic of the controller unit.

A control unit 231 such as a microprocessor microcontroller can coordinate the respective activation of the solenoids 220 and 228 based on the receipt of timing signals from the timing sensor 224 as shown in FIG. 15. The control unit 231 can also control the coin selector 104 when it judges a false coin is determined.

As the excitation of the solenoid 228 causes the warped plate 230 to project on the third conveyer path 202C, the 20-pence coin moving on the conveyer path 202C is moved so that its tip moves away from the guide plate 194 due to the inclined surface of the warped plate 230, thereby dropping downward off from the third coin guide 200C.

The dropped 2-pence coin is guided to a retention bowl of a 2-pence coin hopper 2*p* described later under the guidance of the unshown chute. The reason that the 2-pound coins are first separated is that the 2-pound coins are bimetal coins and are thus most easily separated.

Furthermore, the reason that the 20-pence coins are separated second is that they have a small difference in diameter from the 1-pound coins, so that there is a fear of erroneous separation considering the tolerance of the diameter of the coins when the separation is mechanically performed on the basis of the diametrical difference, and that the 20-pence coins are electrically separated more easily than the 1-pound coins.

However, the positions of the 2-pound separating portion 212 and the 20-pence separating portion 214 can be interchanged. Furthermore, the 2-pound separating portion 212 and the 20-pence separating portion 214 can be changed to a mechanical method of separating by the diametrical difference, similarly to the separating portions described above. In this case, the separating portions are arranged in the order of the increasing diameters of the coins.

It is to be noted that the timing sensor 224, shown in FIGS. 6, 14 and 15 is a sensor to detect the pins 180 attached to the endless proceed member 176, and has a function to output a pulse signal whenever it detects the passage of the pin 180. Therefore, it can be changed to other devices having a similar function.

When the pins 180 are metallic, a proximity sensor can be used for the timing sensor 224, and when the pins 180 are made of a metal or a resin, a photoelectric sensor can be used.

Next, the 5-pence separating portion 216 will be described. In the 5-pence separating portion 216, a 5-pence separating opening 234 is configured by a 5-pence edge 232 located at a predetermined distance, that is, slightly farther away than the diameter of the 5-pence coin in parallel with the third coin guide 200C.

Since the 5-pence coin which has the smallest diameter among the coins except for the 2-pound coin and the 20-pence coin is not supported by the 5-pence edge 232, its upper end collapses into the 5-pence separating opening 234 to deviate its lower end peripheral surface from the third coin guide 200C, thereby being guided to a 5-pence coin hopper 5*p* described later under the guidance of the unshown chute. At this time, because the 5-pence coin is light, it may not easily drop from the third coin guide 200C. That is, when the 5-pence coin is not guided to the 5-pence edge 232 as shown in FIG. 6, its lower surface pivots clockwise on an edge 194E of the guide plate 194.

In order to drop the coin from the third coin guide 200C without dropping it in the 5-pence separating opening 234, it is necessary for the lower peripheral surface of the coin C to deviate from the third coin guide 200C when the coin slightly collapses into the opening 234. In other words, the pivot point of the coin C, that is, the edge 194E needs to be away from the coin guide 200C at a predetermined distance or more. If this distance is long, the coin does not easily collapse due to small moment by its own weight, with the result that the 5-pence coins are not separated in the 5-pence separating portion 216. To prevent this, in the present embodiment, a drop assist member 235 is disposed between the movement path of the pins 180 and the 5-pence edge 232.

Figure 10:
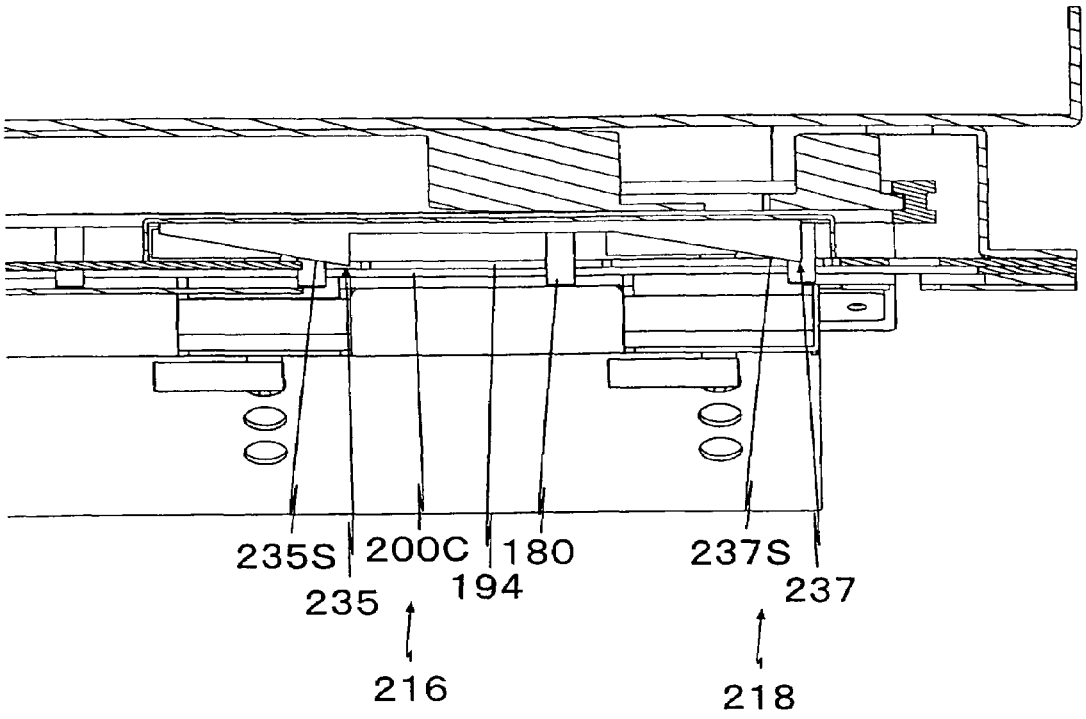
FIG. 10 is a partial plan view of a drop assist device in the embodiment of the present invention.
Figure 11:
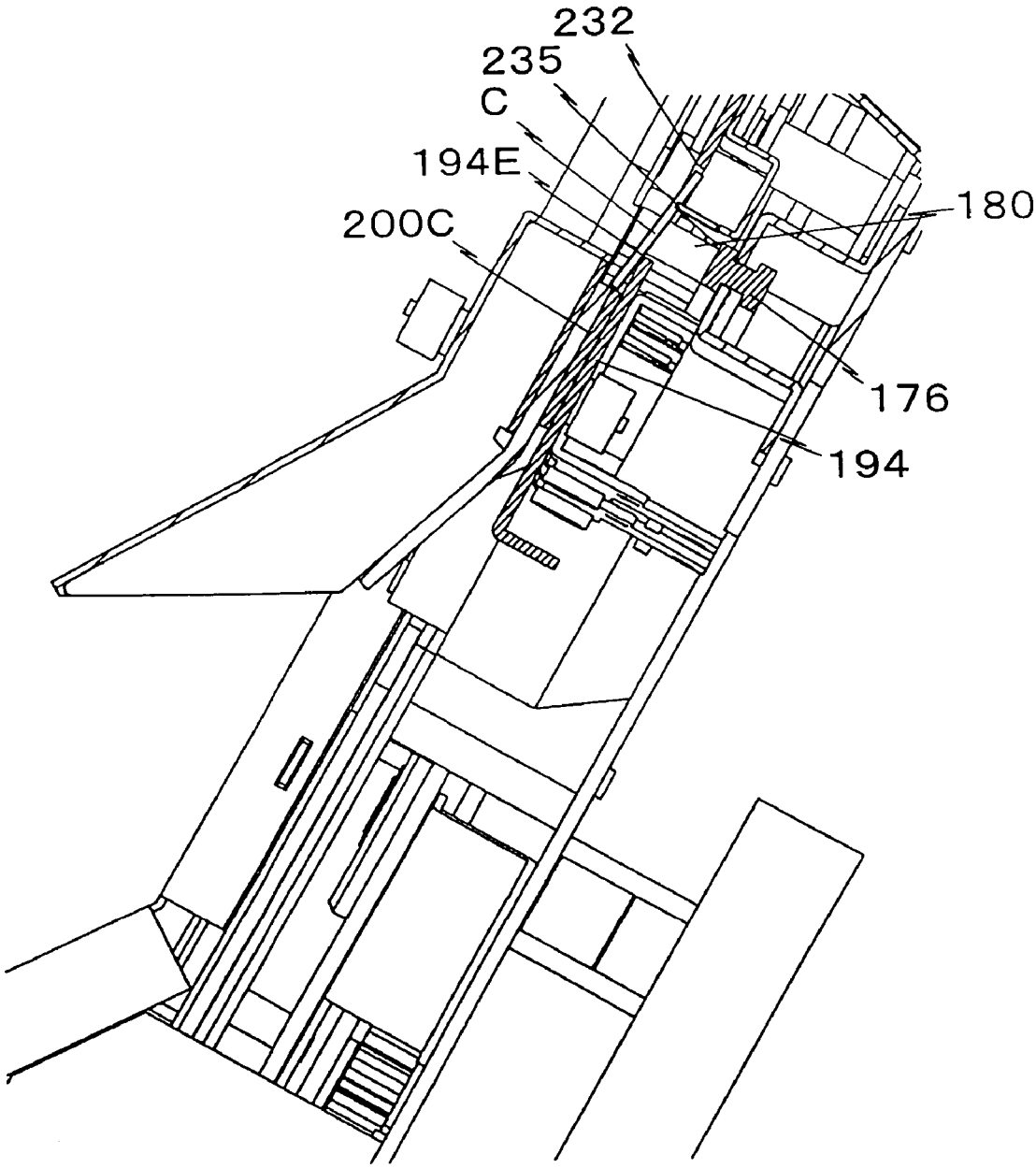
FIG. 11 is a sectional view of the drop assist device in the embodiment of the present invention.

The drop assist member 235 is triangular as shown in FIG. 10, and is disposed so that its inclined surface 235S extends in a proceeding direction of the endless proceed member 176 and comes closer to a rear surface of the third conveyer path 202C as it approaches the downstream.

In accordance with this configuration, even when the distance of the edge 194E from the third guide rail 200C is shortened and the moment by the weight of coin C itself is increased, the lower surface of the upper end of the coin C is supported by the inclined surface 235S of the drop assist member 235 at a predetermined amount of pivoting without dropping from the opening 202C.

Furthermore, the 5-pence coin supported by the inclined surface 235S is pushed by the pins 180, so that its front portion in the traveling direction is turned on the third coin guide 200C to get away from the guide plate 194. Thus, the central lower surface of the 5-pence coin deviates from the third coin guide 200C, so that it drops from the third coin guide 200C.

Next, the 1-penny separating portion 218 will be described. In the 1-penny separating portion 218, a 1-penny separating opening 238 is configured by a 1-penny edge 236 located at a predetermined distance, that is, slightly farther away than the diameter of the 1-penny coin in parallel with the third coin guide 200C. Furthermore, a drop assist member 237 has the same shape as and is positioned in the similar manner to the drop assist member 235.

Since the 1-penny coin which has the second smallest diameter among the coins except for the 2-pound coin and the 20-pence coin is not supported by the 1-penny edge 236, its upper end collapses into the 1-penny separating opening 238 and deviates from the third coin guide 200C with the support of the drop assist member 237, thereby being guided to a 1-penny coin hopper 1*p* described later under the guidance of the unshown chute.

Next, the second separating section 188 will be described. From the upstream side in a conveying direction of the coin conveyer 108, there are sequentially arranged a 1-pound separating portion 240, a 10-pence separating portion 242, a 2-pence separating portion 244 and a 50-pence separating portion 246.

It is to be noted that although not shown in the drawing, the drop assist member is disposed in the opening of each of the above-described separating portions in the same way as described above. However, as these coins have relatively large diameters and are heavy, it is possible to choose not to dispose the drop assist member.

First, the 1-pound separating portion 240 shown in FIG. 8 will be described. In the 1-pound separating portion 240, a 1-pound separating opening 250 is configured by a 1-pound edge 248 located at a predetermined distance, that is, slightly farther away than the diameter of the 1-pound coin in parallel with the fifth coin guide 200E.

Since the 1-pound coin which has the third smallest diameter among the coins except for the 2-pound coin and the 20-pence coin is not supported by the 1-pound edge 248, its upper end collapses into the 1-pound separating opening 250 to deviate from the fifth coin guide 200E, thereby being guided to a 1-pound coin hopper P1 described later under the guidance of the unshown chute.

In the 10-pence separating portion 242, a 10-pence separating opening 254 is configured by a 10-pence edge 252 located at a predetermined distance, that is, slightly coin in parallel with the third coin guide 200C. Furthermore, a drop assist member 237 has the same shape as and is positioned in the similar manner to the drop assist member 235.

Since the 1-penny coin which has the second smallest diameter among the coins except for the 2-pound coin and the 20-pence coin is not supported by the 1-penny edge 236, its upper end collapses into the 1-penny separating opening 238 and deviates from the third coin guide 200C with the support of the drop assist member 237, thereby being guided to a 1-penny coin hopper 1*p* described later under the guidance of the unshown chute.

Next, the second separating section 188 will be described. From the upstream side in a conveying direction of the coin conveyer 108, there are sequentially arranged a 1-pound separating portion 240, a 10-pence separating portion 242, a 2-pence separating portion 244 and a 50-pence separating portion 246.

It is to be noted that although not shown in the drawing, the drop assist member is disposed in the opening of each of the above-described separating portions in the same way as described above. However, as these coins have relatively large diameters and are heavy, it is possible to choose not to dispose the drop assist member.

First, the 1-pound separating portion 240 shown in FIG. 8 will be described. In the 1-pound separating portion 240, a 1-pound separating opening 250 is configured by a 1-pound edge 248 located at a predetermined distance, that is, slightly farther away than the diameter of the 1-pound coin in parallel with the fifth coin guide 200E.

Since the 1-pound coin which has the third smallest diameter among the coins except for the 2-pound coin and the 20-pence coin is not supported by the 1-pound edge 248, its upper end collapses into the 1-pound separating opening 250 to deviate from the fifth coin guide 200E, thereby being guided to a 1-pound coin hopper P1 described later under the guidance of the unshown chute.

In the 10-pence separating portion 242, a 10-pence separating opening 254 is configured by a 10-pence edge 252 located at a predetermined distance, that is, slightly farther away than the diameter of the 10-pence coin in parallel with the fifth coin guide 200E. Since the 10-pence coin which has the fourth smallest diameter among the coins except for the 2-pound coin and the 20-pence coin is not supported by the 10-pence edge 252, its upper end collapses into the 10-pence separating opening 254 to deviate from the fifth coin guide 200E, thereby being guided to a 10-pence coin hopper 10*p* described later under the guidance of the unshown chute.

Next, the 2-pence separating portion 244 will be described.

In the 2-pence separating portion 244, a 2-pence separating opening 258 is configured by a 2-pence edge 256 located at a predetermined distance, that is, slightly farther away than the diameter of the 2-pence coin in parallel with the fifth coin guide 200E. Since the 2-pence coin which has the fifth smallest diameter among the coins except for the 2-pound coin and the 20-pence coin is not supported by the 2-pence edge 256, its upper end collapses into the 2-pence separating opening 258 to deviate from the fifth coin guide 200E, thereby being guided to a 2-pence coin hopper 2*p* described later under the guidance of the unshown chute.

In the 50-pence separating portion 246, a 50-pence separating opening 262 is configured by a 50-pence edge 260 located at a predetermined distance, that is, slightly farther away than the diameter of the 50-pence coin in parallel with the fifth coin guide 200E. Since the 50-pence coin which has the largest diameter among the coins except for the 2-pound coin and the 20-pence coin is not supported by the 50-pence edge 260, its upper end collapses into the 50-pence separating opening 262 to deviate from the fifth coin guide 200E, thereby being guided to a 50-pence coin hopper 50*p* described later under the guidance of the unshown chute.

Next, the coin retention section 112 will be described.

The coin retention section 112 has a function to retain the coins by denomination, and to dispense a specified number of coins of a predetermined denomination when given a dispense command from an unshown command device. Therefore, the coin retention section 112 can be changed to other devices having a similar function. In the present embodiment shown in FIG. 6, the coin retention section 112 includes the coin hoppers P2 to 50*p* provided for the respective denominations.

The coin hoppers P2 to 50*p* have a function to sort the coins retained in bulk in the retention bowls one by one to dispense to the dispensed coin conveying section 114. The coin hoppers P2, 20*p*, 5*p* and 1*p* are arranged in line to correspond to the first separating section 186, and disposed above one side of the coin conveying section 114. The coin hoppers 50P, 2P, 10P and P1 are arranged in line to correspond to the second separating section 188, and disposed on the other side of the coin conveying section 114.

The coin dispense conveying section 114 has a function to convey, in a predetermined direction, the coins dispensed from the coin hoppers P2 to 50*p*. In the present embodiment, the coin dispense conveying section 114 is a flat belt 264 disposed substantially horizontally between the coin hopper lines, and is driven in a predetermined direction by an unshown electric motor, and conveys the coins C dispensed from the hoppers to the coin allotting section 116.

The coin allotting section 116 has a function to allot the coins C received from the coin dispense conveying section 114 to the overflow coin safe 118 or the coin dispensing section 120. The coin allotting section 116 guides the accepted coin C to the overflow coin safe 118 only when the overflow coin is dispensed from any one of the coin hoppers P2 to 50*p*, and guides it to the coin dispensing section 120 in other cases.

The overflow coin safe 118 has a function to retain the coins C received from the dispensed coin allotting section 116. A change replenish device 266 is disposed above the coin retention section 112. The change replenish device 266 has a function to supply the coins thrown in bulk from an opening 268 to the retention bowl 122 of the coin delivery device 106. In the present embodiment, it includes a flat belt 270 disposed substantially horizontally.

When a cover of a case is opened and a predetermined number of various coins are thrown from the opening 268, the coins are stacked in bulk on the flat belt 270. When the coins stacked in bulk are detected by an unshown sensor, the flat belt 270 moves them to the coin delivery device 106 side at a moderate velocity.

The coins C having reached an end of the flat belt 270 drop, and are guided to the retention section 152 of the coin delivery device 106 by the unshown chute. When the sensor disposed in the coin delivery device 106 detects a predetermined amount of coins C in the retention section 152, the movement of the flat belt 270 is stopped, and the replenishment of the coins C for the change is stopped. When the sensor has detected that the retention section 152 is empty, the flat belt 270 is again moved, and the coins C are supplied to the retention section 152.

If this operation is repeated and if the coins C on the flat belt 270 and the coins C in the retention section 152 run out, the denomination sensor 204 does not detect any coin for a predetermined time, so that a non-detection signal is used to indicate the completion of the replenishment of the change.

Next, the operation of the present embodiment will be described.

The coin C thrown in the coin slot 102 is judged whether it is true or false in the coin selector 104. The true coin C drops into the retention section 152 of the coin delivery device 106. When the unshown sensor detects the coin C in the retention section 152, the unshown electric motor is rotated, and the sprocket 184 is rotated. Thus, the chain 182 is moved in a predetermined direction, in a counterclockwise direction in FIGS. 6 and 8, at a predetermined velocity. Furthermore, the rotary disk 124 is rotated clockwise synchronously with the chain 182 via the gears 186 and 188.

In this way, the thrown coin C slips down to the rotary disk 124 side due to the inclined bottom of the retention bowl 122, and contacts the rotary disk 124 and the push-out disk 140. The rotation of the rotary disk 124 causes the coins C to be stirred by the protruding portion 126 and to enter the sorting concave portions 134.

At positions other than the position in the vicinity of the coin conveyer 108, the moving member 130 is positioned in the receiving portion 144, and is thus at the receiving position RP. In other words, the concave portion 134 is fan-shaped. Therefore, only one coin C is held in the sorting concave portion 134 defined by the pushing portion 142 of the protruding portion 126 and by the arc-shaped edge 131 of the moving member 130. That is, the outer periphery of the coin C is guided by the retention ring 148, so that only one maximum diameter coin C is held in the concave portion 134 which is formed slightly more deeply than the diameter of the maximum diameter coin (2-pound coin).

Furthermore, as its depth is less than double the diameter of the minimum diameter coin (5-pence coin), two minimum diameter coins cannot enter in the diametrical direction of the rotary disk 124. Moreover, the concave portion 134 is fan-shaped, so that two minimum diameter 5-pence coins cannot be arranged side by side in the circumferential direction of the rotary disk 124. Therefore, only one minimum diameter 5-pence coin is held in the sorting concave portions 134.

The rotation of the rotary disk 124 causes the coin C held in the concave portion 134 to move to the coin conveyer 108 side. In other words, the coin C is moved upward. At this point, the coin C is pushed and moved by the pushing portion 142, and almost no force is applied to the moving member 130.

When the moving member 130 has moved near the coin conveyer 108, the moved member 154 moves in the deliver process groove 172, so that the moved member 154 is moved in the diametrical direction of the rotary disk 124. Thus, the moving member 130 is caused to pivot clockwise on the pivot shaft 146. Therefore, the moving member 130 pushes the coin C positioned in the sorting concave portion 134 from the lateral side in the diametrical direction of the rotary disk 124, thereby pushing out the coin C from the sorting concave portion 134.

Then, when the moved member 154 is positioned in the movement groove 170, the moving member 130 moves to the moving position MP, so that the coin C passes through the opening 150 and is pushed out to the movement path of the pin 180. Immediately after being pushed out, the coin C is pushed by the pin 180, and transferred under the guidance of the first coin guide 200A, the second coin guide 200B, the third coin guide 200C, the fourth coin guide 200D and the fifth coin guide 200E. In other words, the coin C is conveyed sequentially on the first conveyer path 202A, the second conveyer path 202B, the third conveyer path 202C, the fourth conveyer path 202D, and the fifth conveyer path 202E.

In the second conveyer path 202B, the coin C is detected by the denomination sensor 204, and the denomination is identified. If the coin C is judged to be a 2-pound coin, the solenoid 220 is excited for a predetermined time in accordance with the initial pulse signal from the timing sensor 224 after the judgment.

As this excitation causes the warped plate 222 to project on the third conveyer path 202C, the 2-pound coin moving on the peripheral surface while being pushed by the pin 180 under the guidance of the second coin guide 232 is moved away from the guide plate 194 by the warped plate 222. Thus, the 2-pound coin is deviated from the third coin guide 200C and drops in the coin hopper P2 under the guidance of the unshown chute.

If the coin C is judged to be a 20-pense coin, the solenoid 228 is excited for a predetermined time in accordance with the output of two pulse signals from the timing sensor 224 after the judgment. As this excitation causes the warped plate 230 to project on the third conveyer path 202C, the 20-pence coin is moved away from the guide plate 194 by the warped plate 230. Thus, the 20-pence coin is deviated from the third coin guide 200C and drops in the coin hopper 20*p* under the guidance of the unshown chute.

Except for the 2-pound coin and the 20-pence coin, the solenoids 220 and 228 are not excited in accordance with the detection of the denomination sensor 204, so that the conveyed coin C passes the 2-pound separating portion 212 and the 20-pence separating portion 214 and reaches the minimum diameter 5-pence separating portion 216.

If the conveyed coin C is a 5-pense coin, its upper end is not guided by the edge 232 of the 5-pence separating opening 234, so that the upper end of the coin C falls in the 5-pence separating opening 234, and deviates from the third coin guide 200C to drop in the coin hopper 2*p* under the guidance of the unshown chute, as described above.

In the case of the second smallest 1-penny coin, it passes the 5-pence separating portion 216 under the guidance of the edge 232 because its diameter is larger than the diameter of the 5-pence coin. However, in the 1-penny separating portion 218, it deviates from the third coin guide 200C in the same way as the 5-pence coin, and drops in the coin hopper 1*p* under the guidance of the unshown chute.

In the case of the 1-pound coin, it passes the first selecting section 186 and the fourth conveyer path 202D to reach the 1-pound separating portion 240, and deviates from the fifth coin guide 200E in the same way as the 5-pence coin, thereby dropping in the coin hopper P1 under the guidance of the unshown chute.

In the case of the 10-pence coin, it passes the first selecting section 186, the fourth conveyer path 202D and the 1-pound separating portion 240 to reach the 10-pence separating portion 242, and deviates from the fifth coin guide 200E in the same way as the 5-pence coin, thereby dropping in the coin hopper 10*p* under the guidance of the unshown chute.

In the case of the 2-pence coin, it passes the first selecting section 186, the fourth conveyer path 202D, the 1-pound separating portion 240 and the 10-pence selecting portion 242 to reach the 2-pence selecting portion 244, and deviates from the fifth coin guide 200E in the same way as the 5-pence coin, thereby dropping in the coin hopper 2*p* under the guidance of the unshown chute.

In the case of the 50-pence coin, it passes the first selecting section 186, the fourth conveyer path 202D, the 1-pound separating portion 240, the 10-pence selecting portion 242 and the 2-pence selecting portion 244 to reach the 50-pence selecting portion 246, and deviates from the fifth coin guide 200E in the same way as the 5-pence coin, thereby dropping in the coin hopper 5*p* under the guidance of the unshown chute.

If the 2-pound coin is not identified by the sensor 204, the 2-pound coin does not drop in the 20-pence selecting portion 214, and does not drop in the 5-pence selecting portion 216, the 1-penny selecting portion 218, the 1-pound selecting portion 240, the 10-pence selecting portion 242, the 2-pence selecting portion 244 and the 50-pence selecting portion 246, thus reaching the lowermost portion 208 of the conveyer path. In this case, the 2-pound coin drops in the retention section 152 of the coin delivery device 106 under the guidance of the guide device 206. Thus, this 2-pound coin is transferred to the coin conveyer 108 by the coin delivery device 106, detected again in the sensor 204, and separated in the 2-pound separating portion 212.

If it is not separated in the 2-pound separating portion 246 either the second time, it is further again transferred from the coin delivery device 106 to the coin conveyer 108, and separation is attempted in the 2-pound separating portion 246. If the thrown coin is a false coin, it is returned from the coin selector 104 to the coin dispensing section 120.

Before the operation, to retain the change in the coin hoppers P2 to 50*p*, the coins in bulk are thrown from the opening 268 onto the flat belt 270, so that the flat belt 270 proceeds as described above to supply the coin C to the retention section 152 of the coin delivery device 106. In this way, the coins are received from the coin delivery device 106 to the coin conveyer 108 as described above, separated by denomination in the process of being conveyed in the first separating section 186 and the second separating section 188, and retained in the coin hoppers.

The present invention can be used in a coin receiving device which receives coins of a plurality of denominations in bulk and sorts them one by one for separation by denomination in the process of conveyance on a conveyer path.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. In a coin delivery device of a coin processing apparatus which holds coins in sorting arc-shaped concave portions arranged in an upper surface of a rotary disk to sort the coins one by one, and then transfers the coins to a coin conveyer, the improvement comprising:

a curved moving member forms an interior coin contacting surface of each sorting concave portion and is rotably movable on the rotary disk, each sorting concave portion is open on a peripheral side surface of the rotary disk, the sorting concave portion has a coin pushing portion at one part, wherein the curved moving member is moved on the rotary disk when the coin is transferred to the coin conveyer and is positioned at a side of the coin pushing portion when the coin is received, and moved to the peripheral surface opening side when the coin is transferred, wherein the curved moving member is arc-shaped and attached to the rotary disk so as to be able to pivot on one end, and a moved member attached to the curved moving member is inserted in a groove cam located under the rotary disk.

2. A coin processing apparatus which sorts a coin from a plurality of denominations of coins, one by one, by a delivery device, and then transfers the coin to a conveyer, and separates the coin by denomination in a coin separating section disposed on a conveyer path of the conveyer, characterized in that a guide device is provided to guide the coin which has reached a lowermost portion of the conveyer path from the delivery device wherein the conveyer path has a first separating section extending linearly substantially in a horizontal direction from the delivery device and a second separating section extending successively from the first separating section in an opposite direction above the first separating section, and wherein the conveyer path includes a U-shape portion, and wherein a lowermost portion of the conveyer path is disposed above the delivery device.

3. The coin processing apparatus according to claim 2, wherein the delivery device of the coin includes a sorting concave portion which is formed in an inclined rotary disk and whose upper surface and peripheral surface are open and a moving member which is held at a receiving position to form the concave portion and which, at a subsequent predetermined position of the rotary disk rotably moves in a diametrical direction of the rotary disk, and wherein the conveyer includes pins provided in an endless proceed member and the guide device guides the coin moved by the conveyer.

4. A coin delivery device for selectively removing coins from bulk storage, comprising, a rotary disk with coin receiving indentations and an eject cam path;

a movable member forming a portion of a perimeter of one of the indentations and providing a support surface for contact with the coin, the movable member is pivotally mounted to the rotary disk;

a follower member is mounted in the eject cam path and operatively connected to the movable member, wherein an endless cam groove is provided under the rotary disk that crosses the direction of the eject cam path and the follower member is journalled in both the eject cam path and the endless groove cam; and an activator unit for moving the movable member to eject the coin at a discharge position.

5. The coin delivery device of claim 4 wherein the movable member is arc-shaped.

6. A coin processing apparatus for separating coins of different sizes comprising;

a coin retention bowl storing coins of different sizes;

a coin delivery device is operatively connected to the coin retention bowl and includes a rotary disk with coin receiving indentations, a movable member within the coin receiving indentations for providing a support surface for contact with a coin and an activator unit for moving the movable member to eject a coin at a discharge position, an endless cam groove is provided under the rotary disk and an eject cam path crosses the endless cam groove, and a follower member during movement of the movable member is journalled in the eject cam path and the endless groove path to operatively position the moveable member for receiving and ejecting different size coins; and an endless coin conveyor operatively positioned to receive a coin from the coin delivery device and, configured to provide an operative U-shaped portion to segregate coins of different dimensions wherein coins are separated as coins are moved away from the coin delivery device and as coins are moved towards the coin delivery device.

7. The coin processing apparatus of claim 6 wherein a guide device guides the coins on the U-shaped portion as coins are moved towards the coin delivery device.

8. The coin processing apparatus of claim 7 wherein the endless coin conveyor includes pins for transporting the coins.

9. The coin processing apparatus of claim 7 wherein the endless coin conveyor is mounted to position the U-shaped portion in an approximate vertical alignment with a first separating section to extending linearly in a substantially horizontal direction and a second separating section to extend linearly in a substantially horizontal direction below the first separating section.

10. A coin delivery device for selectively removing coins from bulk storage, comprising:

a rotary disk with coin receiving indentations;

a movable member forming a portion of a perimeter of one of the indentations and providing a support surface for contact with the coin;

an activator unit for moving the movable member to eject the coin at a discharge position including an eject cam path, an endless cam groove is provided under the rotary disk to cross the direction of the eject cam path, and a follower member is journaled in both the eject cam path and the endless groove cam, wherein the movable member is controlled by the activator unit to automatically discharge the coin from one of the coin receiving indentations at a predetermined location.

11. A coin delivery device for selectively removing coins from bulk storage, comprising, a rotary disk with variable space coin receiving indentations and an eject cam path;

a movable member forming a portion of a perimeter of one of the indentations and providing a support surface for contact with a coin, the movable member is pivotally mounted to the rotary disk;

a follower member is mounted in the eject cam path and operatively connected to the movable member to move the movable member for receiving and discharging a coin from one of the coin receiving indentations; and an endless coin conveyor operatively positioned to receive a coin from the coin delivery device and, configured to provide an operative U-shaped portion to segregate coins of different dimensions wherein coins are separated as coins are moved away from the coin delivery device and as coins are moved towards the coin delivery device including a plurality of coin guides of different thicknesses to support the coins as the coins are transported by the endless coin conveyor until separated, the endless coin conveyor and plurality of coin guides are positioned at an angle to a vertical plane to cause the coins to tilt relative to the vertical plane.

* * * * *